US005471688A

United States Patent [19]

Cavazos

[11] Patent Number: 5,471,688

[45] Date of Patent: Dec. 5, 1995

[54] MODULAR INNERSPRING AND BOX SPRING ASSEMBLIES

[76] Inventor: Frank G. Cavazos, 14040 Shoshoni Dr., Lockport, Ill. 60441

[21] Appl. No.: 203,100

[22] Filed: Feb. 28, 1994

[51] Int. Cl.[6] ..... A47C 23/04

[52] U.S. Cl. ..... 5/251; 5/260; 5/475

[58] Field of Search ..... 5/259.1, 260, 258, 5/269, 270, 475, 477, 200.1, 201, 202, 240, 249, 251, 248, 252, 256, 285

[56] References Cited

U.S. PATENT DOCUMENTS

| | | | |
|---|---|---|---|
| 272,076 | 2/1883 | Mueller | 5/251 |
| 428,637 | 5/1890 | Schmitt | 5/249 |
| 1,185,575 | 5/1916 | Anthony | 5/249 |
| 1,343,620 | 6/1920 | Gainer | 5/249 |
| 1,497,710 | 6/1924 | Cole | 5/259.1 |
| 1,725,356 | 8/1929 | Kiwi | 5/248 |
| 3,176,325 | 4/1965 | Levine | 5/249 |
| 4,402,097 | 9/1983 | Scott | 5/201 |
| 4,956,884 | 9/1990 | Hwang | 5/259.1 |
| 5,144,706 | 9/1992 | Walker | 5/201 |

FOREIGN PATENT DOCUMENTS

| | | | |
|---|---|---|---|
| 188399 | 9/1907 | Austria | 5/249 |
| 806711 | 6/1951 | Germany | 5/260 |

*Primary Examiner*—Flemming Saether
*Attorney, Agent, or Firm*—Ernest Kettelson

[57] ABSTRACT

A modular innerspring and box spring assembly which can be put together by the end use customer from innerspring and box spring modules. An innerspring module consists of a plurality of coil springs joined together by helical wire fasteners in a generally rectangular configuration having dimensions which when assembled with other like modules in side-by-side and end-to-end relationship make up a completed modular innerspring assembly of the size and shape needed to make a twin, twin extra long, full, full extra long, queen and king size mattress. A top boundary wire assembly extends around the top peripheral edge of the completed modular innerspring assembly and a bottom boundary wire assembly extends around the bottom peripheral edge, in each case secured to adjacent coil springs by a double hook clip. A box spring module consists of a frame made up of end and side strips plus intermediate slats having a plurality of springs secured thereto and extending upwardly therefrom in a generally rectangular configuration having dimensions which when connected with other like box spring modules in side-by-side and end-to-end relationship make up a completed modular box spring assembly of whatever size and shape needed to support a twin, twin extra long, full, full extra long, queen and king size mattress. The box spring modules are secured together by L-shaped angle irons on each bolted to those of adjacent modules.

27 Claims, 24 Drawing Sheets

MODULAR INNERSPRING AND BOX SPRING ASSEMBLIES

BACKGROUND OF THE INVENTION

This invention relates to the field of spring assemblies for mattresses which can be assembled by an end use purchaser from component parts.

Prior art spring assemblies for mattresses which are closest to the present invention of which the inventor has knowledge include those described in the following United States patents.

U.S. Pat. No. 5,214,809 discloses an articulated mattress for an adjustable bed which has hinge portions between mattress sections for limited pivotal movement of one section relative to another.

U.S. Pat. No. 5,040,255 discloses a cushion or mattress structure comprising a box structure with side, top and bottom walls of foam material, and cavity within the box to receive encased springs.

U.S. Pat. No. 4,956,884 discloses a modular box spring mattress comprising a plurality of plate sub units in which coil springs are received and held by flexible retaining arms. The sub units have cooperative coupling structures to hold adjacent sub units together.

U.S. Pat. No. 4,868,941 discloses an assembled mattress having an upper sheet with integrally formed sleeves or bellows extending downward and a lower sheet with integrally formed sleeves or bellows extending upward, with individual coil springs seated in each of the sleeves or bellows.

U.S. Pat. No. 2,547,840 discloses a sectional mattress comprising three separate sections positioned end to end, with one end of a coil spring connected at each end of the middle section and on both sides thereof, having the other end of each coil spring connected to the adjacent mattress section at each opposite end of the middle section.

U.S. Pat. No. 2,446,775 discloses an innerspring mattress construction made up of sections which are glued together along facing end walls to make up a completed mattress.

U.S. Pat. No. 2,249,266 discloses a combined chair and bed having a mattress like coil spring cushion supported on a hinged frame which folds down into a bed and angularly to form a chair in one position and a recliner in another.

U.S. Pat. No. 2,216,991 discloses three mattress units which are connected end to end to make a complete mattress. The units are connected by a transverse cylindrical bar insert on one unit which is received in a sleeve have a split cylindrical wall around its through passageway on the adjacent unit.

U.S. Pat. No. 1,915,674 discloses a coil spring assembly for making cushions, comprising four or more coils in a row connected by an elongated endless loop of twisted wire which includes one elongated strand connected to one side of each coil in the row and a second parallel strand connected to the opposite side of each coil in the row, such rows of coils in turn being connected to adjacent rows of coils by C-wires or fasteners known as hog rings.

U.S. Pat. No. 1,459,540 discloses a sectional mattress comprising three separate sections that are laid end to end to make up a complete mattress and can be interchanged in their relationship to each other. The innersprings within each section are encased in bags.

OBJECT OF THE INVENTION

The modular innerspring and box spring assemblies in accordance with the present invention provide an improvement over the prior art in that end use customers can buy the component parts and assemble their own completed modular innerspring assemblies and box spring assemblies. The modular innerspring assemblies can then be used by the end use customer to put together his own innerspring mattress from component parts in accordance with a separate invention for which a separate patent application is being filed concurrently.

The modular innerspring assembly is made from innerspring modules in different sizes to make twin, twin extra long, full, full extra long, queen and king size innerspring assemblies. The coils in each module are held together by helical wire fasteners comprising an elongated wire wound in a helix whereby the wire forms a helical cylindrical wall surrounding a cylindrical bore in which the coils of adjacent coil springs are received to hold them together.

When the innerspring modules are placed next to each other at their adjacent sides and ends to make up a completed innerspring assembly of the desired size, a border wire assembly is then secured around the top and bottom peripheral edges of such completed assembly by double hook clip members, one hook end receiving a portion of the border wire and the other hook end receiving the facing portion the top coil of an adjacent spring in the case of the top border wire assembly and of the bottom coil of the adjacent spring in the case of the bottom border wire assembly.

Each border wire assembly comprises L-shaped wire members for each corner, and straight wire members where needed to connect the L-shaped wire members at each corner. Elongated sleeve members are provided to receive the adjacent ends of the wire members, which together with the double hook clips hold the border wire assemblies to the periphery of the completed modular innerspring assemblies to thereby hold the modules of the completed assemblies in place as a completed unit.

The modular box spring assembly in accordance with this invention is made from box spring modules in different sizes to also make twin, twin extra long, full, full extra long, queen and king size box spring assemblies. The king size assemblies may be two separate twin size extra long modular box spring assemblies placed side by side.

The box spring modules comprise a wood frame made up of end strips and side strips with intermediate slots therebetween to which upwardly extending coil springs or Z-shaped springs are secured. Four box spring modules are laid side by side and end to end to make up a completed modular box spring assembly and connected together by elongated L-shaped angle irons whose horizontal legs are bolted to the frame and whose vertical legs extend upwardly above the level of the frame having apertures to receive bolts that secure facing vertical legs of the angle irons of adjacent box spring modules together.

Other advantages and features of the modular innerspring and box spring assemblies in accordance with this invention will become apparent from the detailed description which follows and from the accompanying drawings.

DESCRIPTION OF PREFERRED EMBODIMENT

Figure 1:
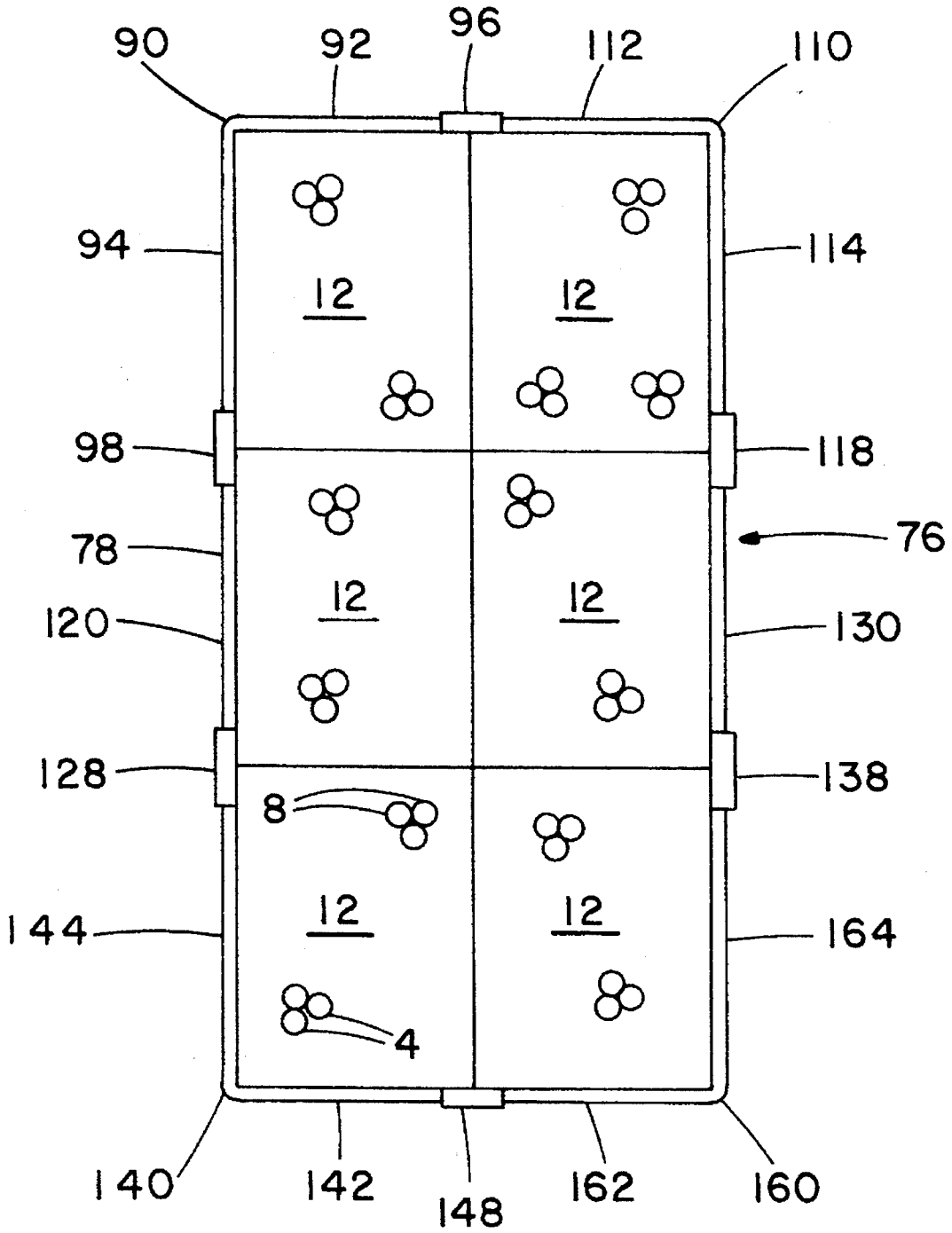
FIG. 1 is a top plan view of an assembled twin size modular innerspring assembly in accordance with this invention.
Figure 2:
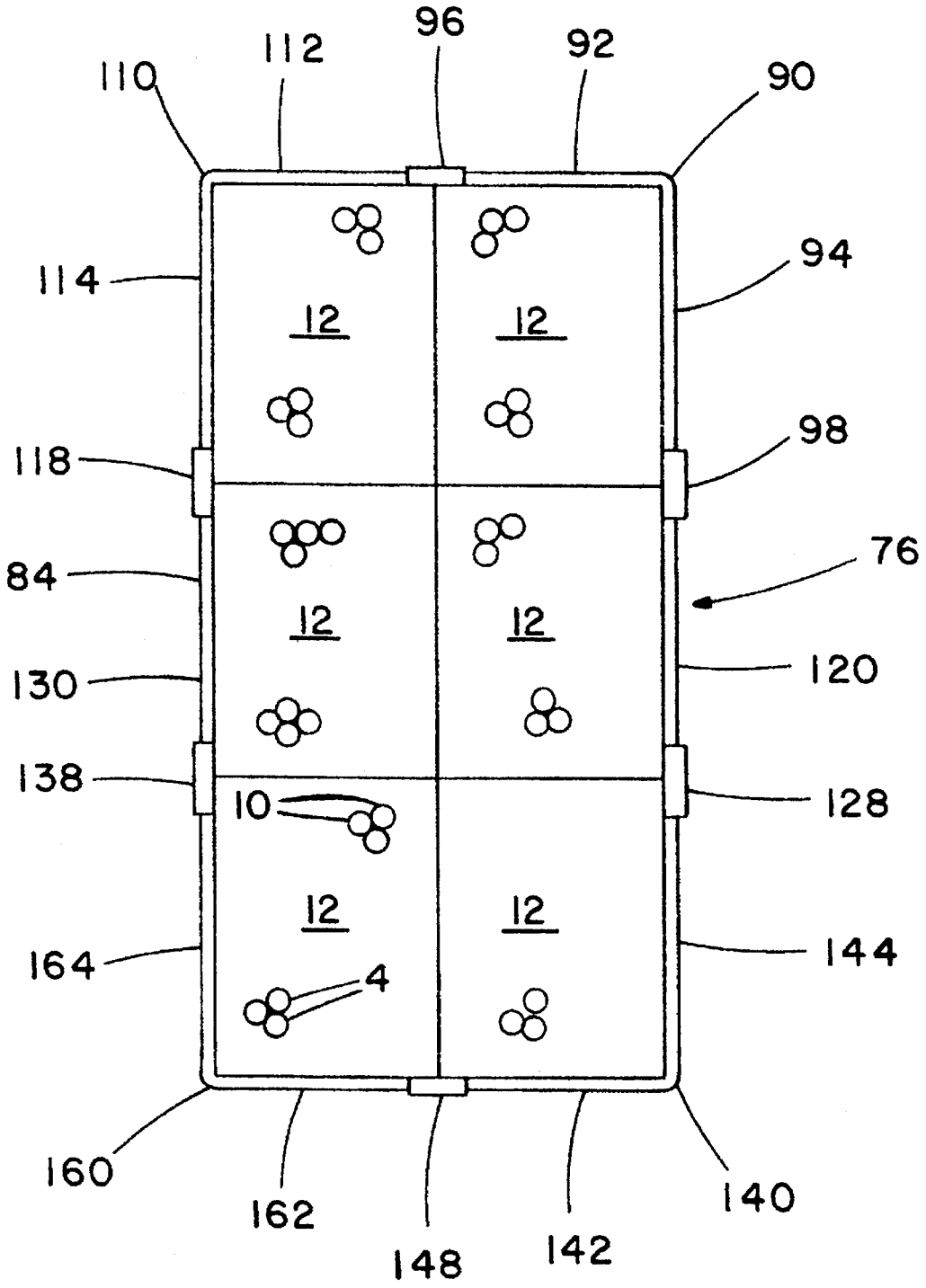
FIG. 2 is a bottom plan view of the modular innerspring assembly of FIG. 1.
Figure 3:
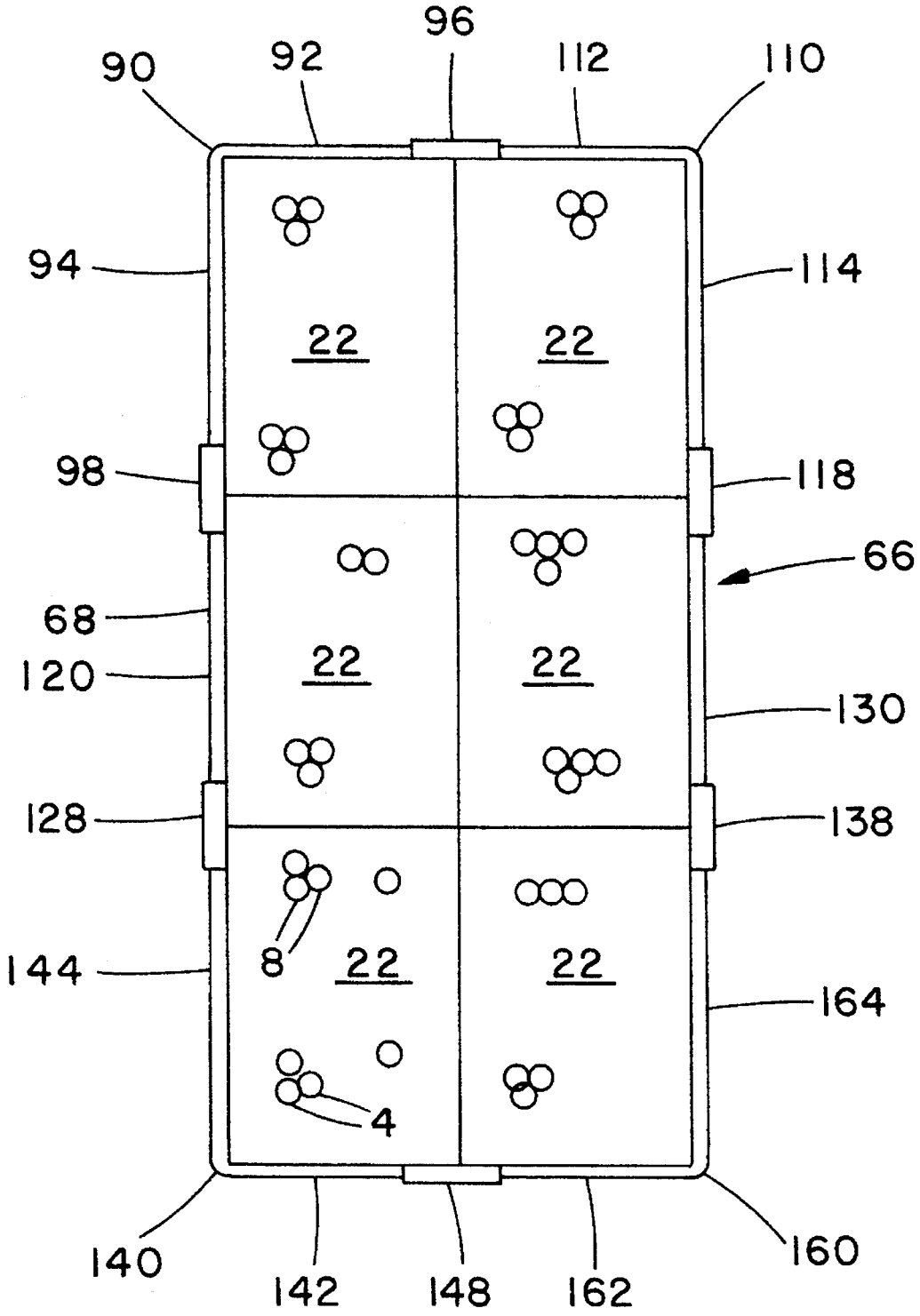
FIG. 3 is a top plan view of an assembled twin size extra long modular innerspring assembly in accordance with this invention.
Figure 4:
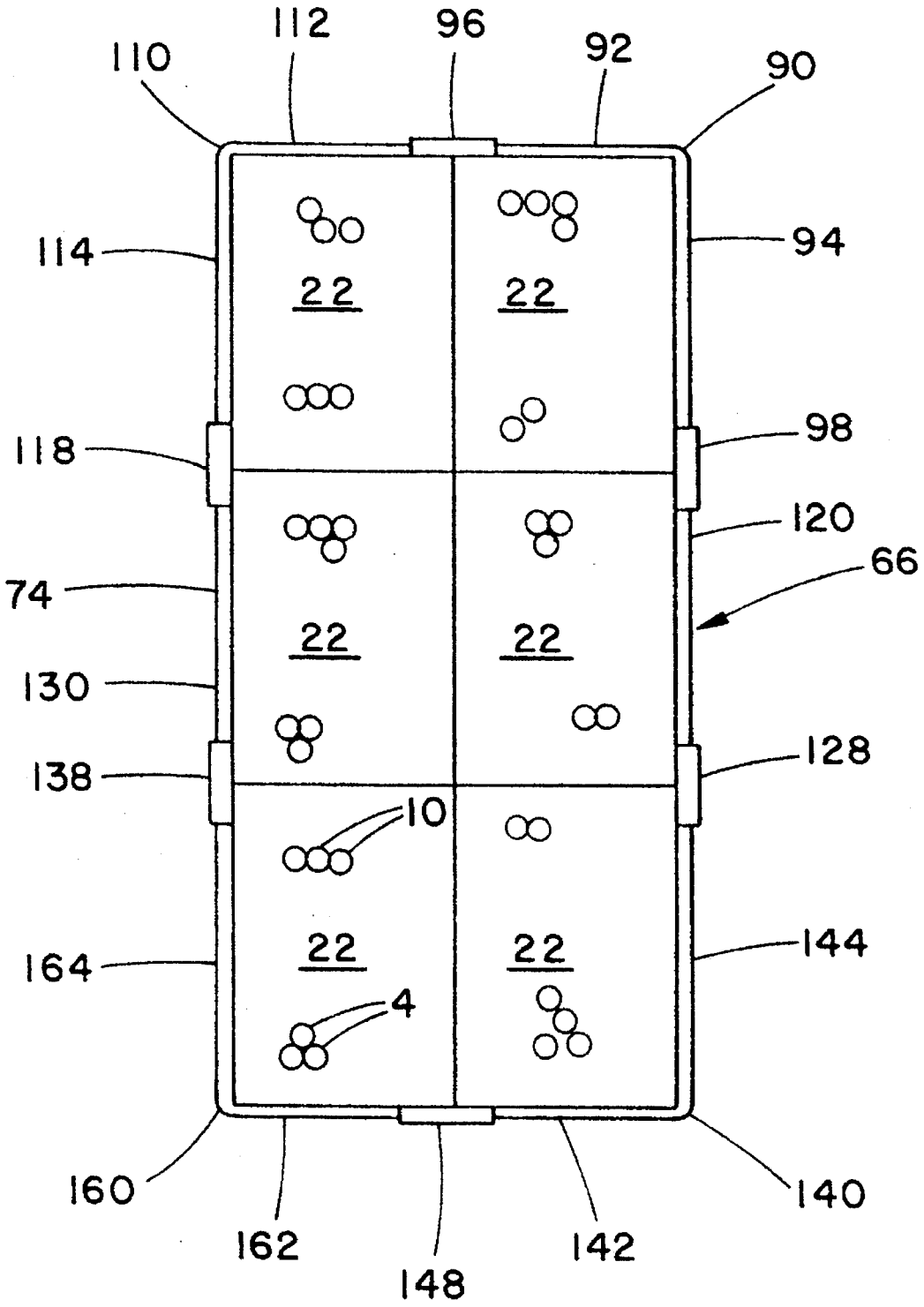
FIG. 4 is a bottom plan view of the modular innerspring assembly of FIG. 3.
Figure 5:
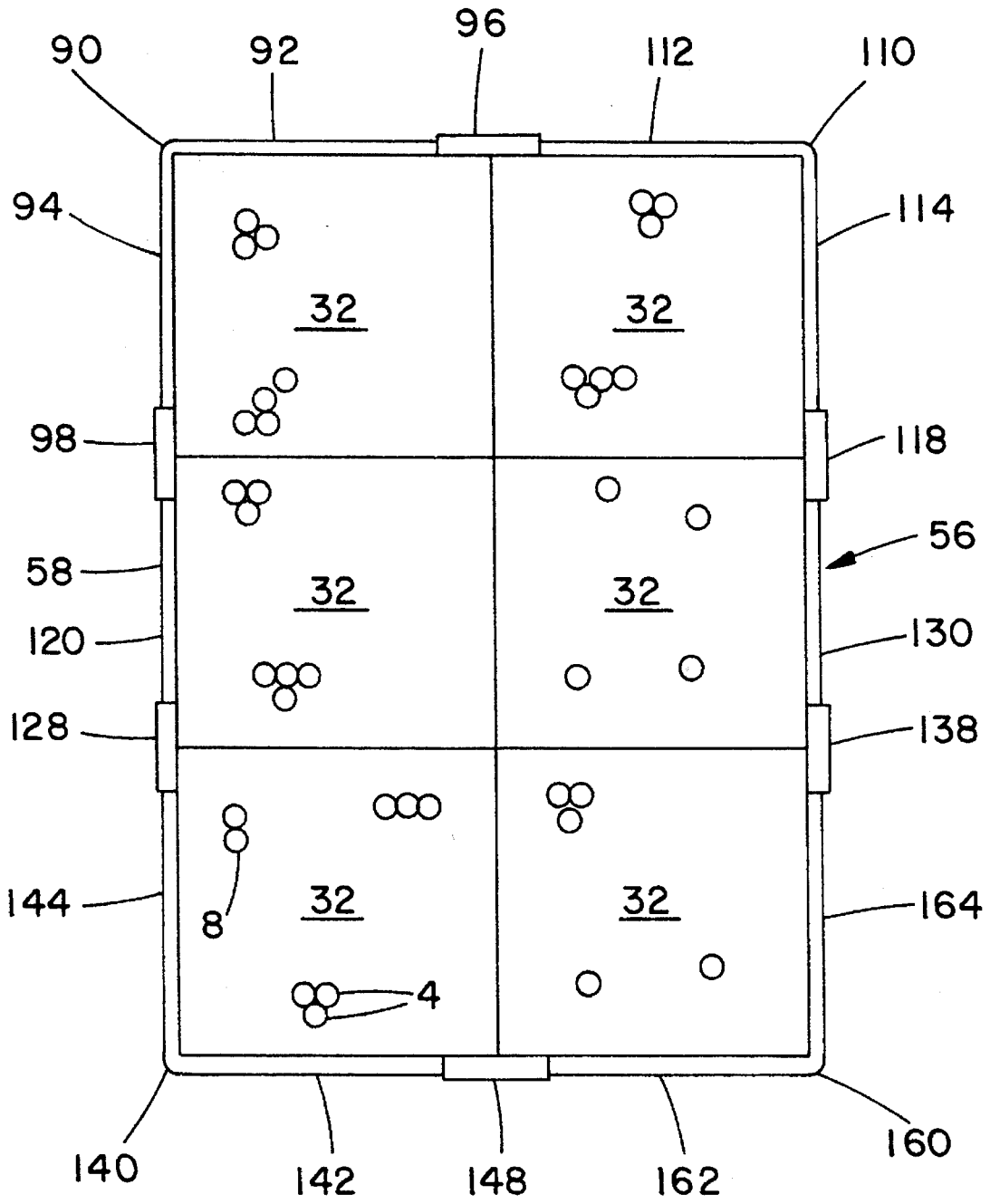
FIG. 5 is a top plan view of an assembled full size modular innerspring assembly in accordance with this invention.
Figure 6:
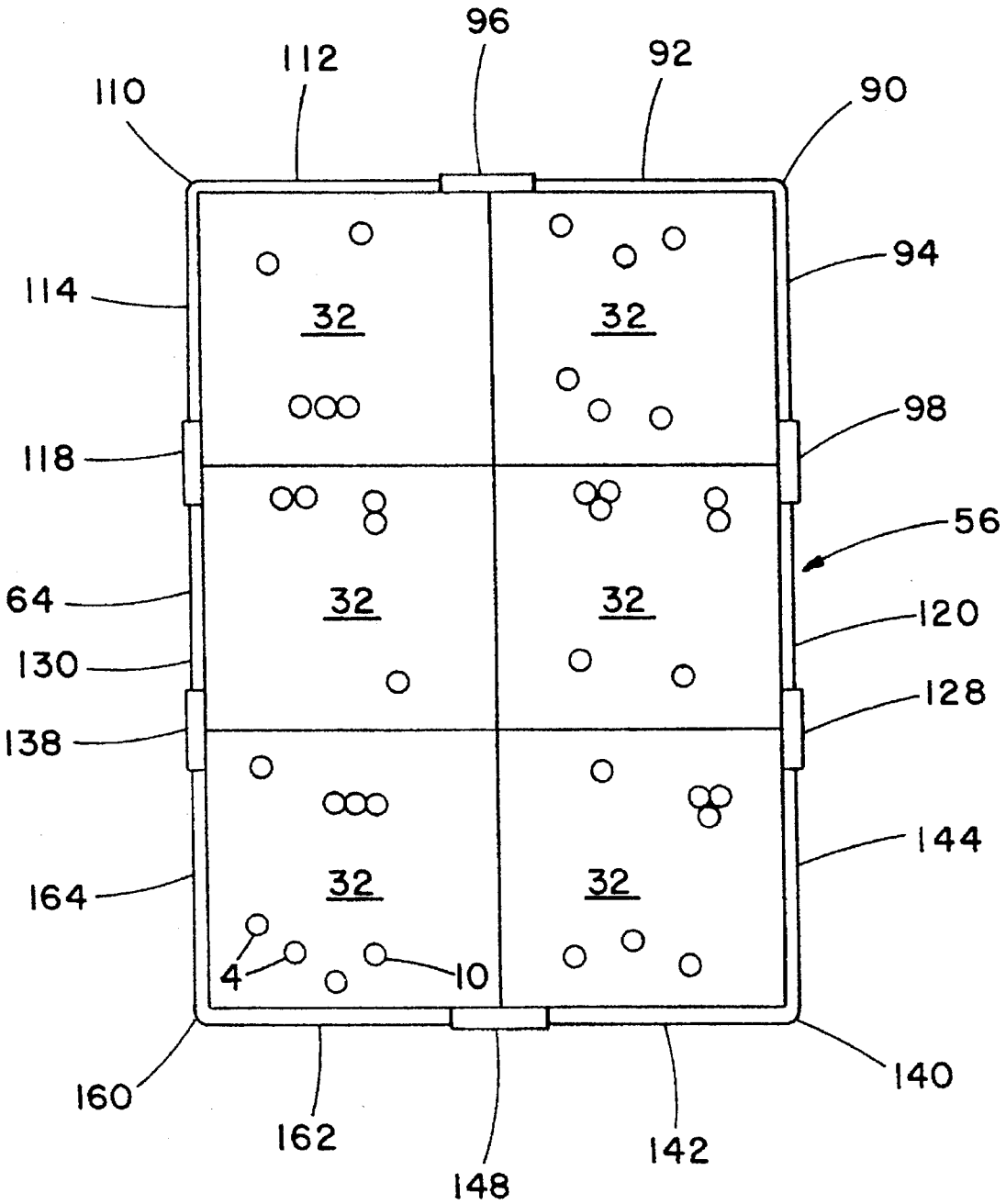
FIG. 6 is a bottom plan view of the modular innerspring assembly of FIG. 5.
Figure 7:
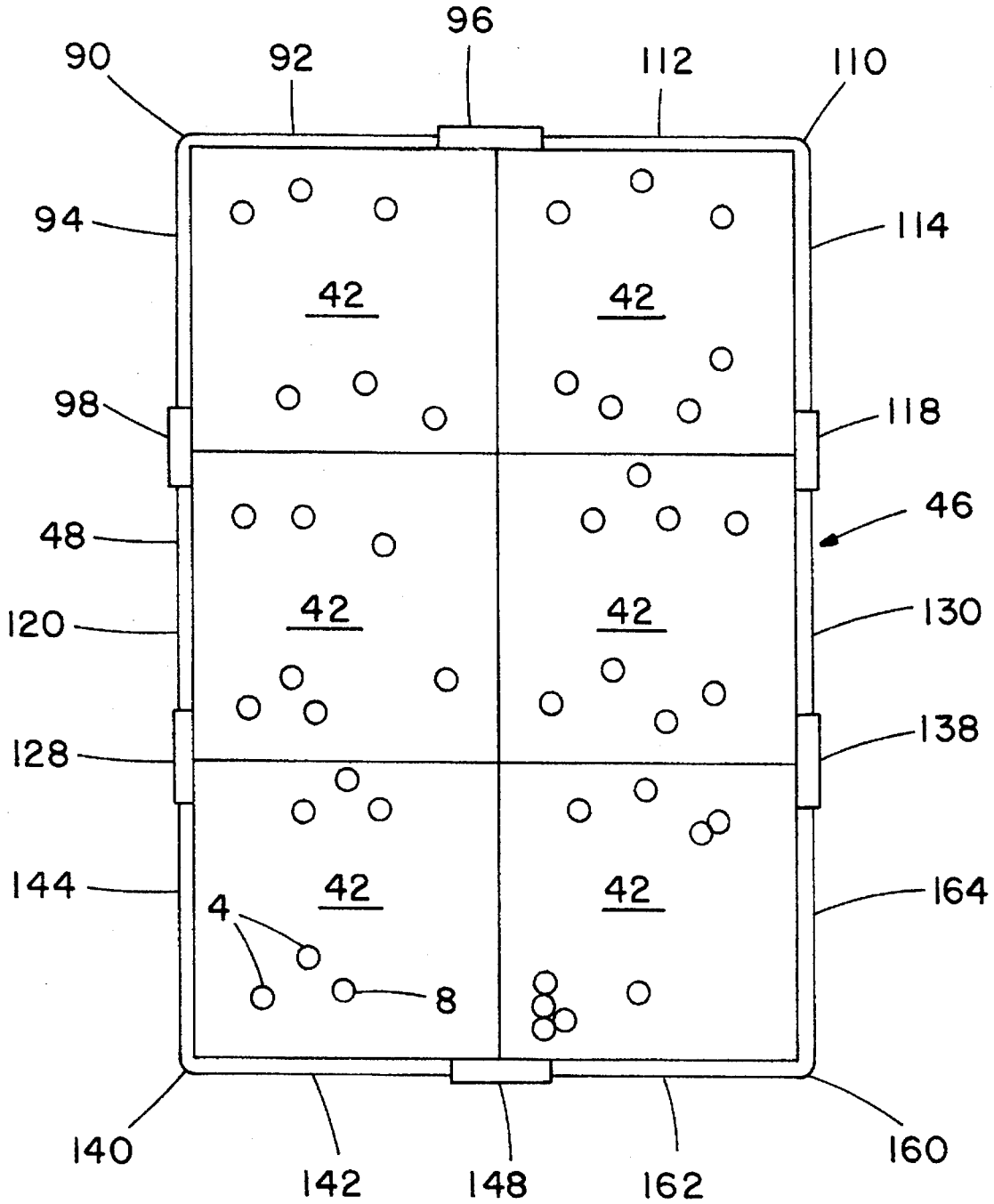
FIG. 7 is a top plan view of an assembled full size extra long modular innerspring assembly in accordance with this invention.
Figure 8:
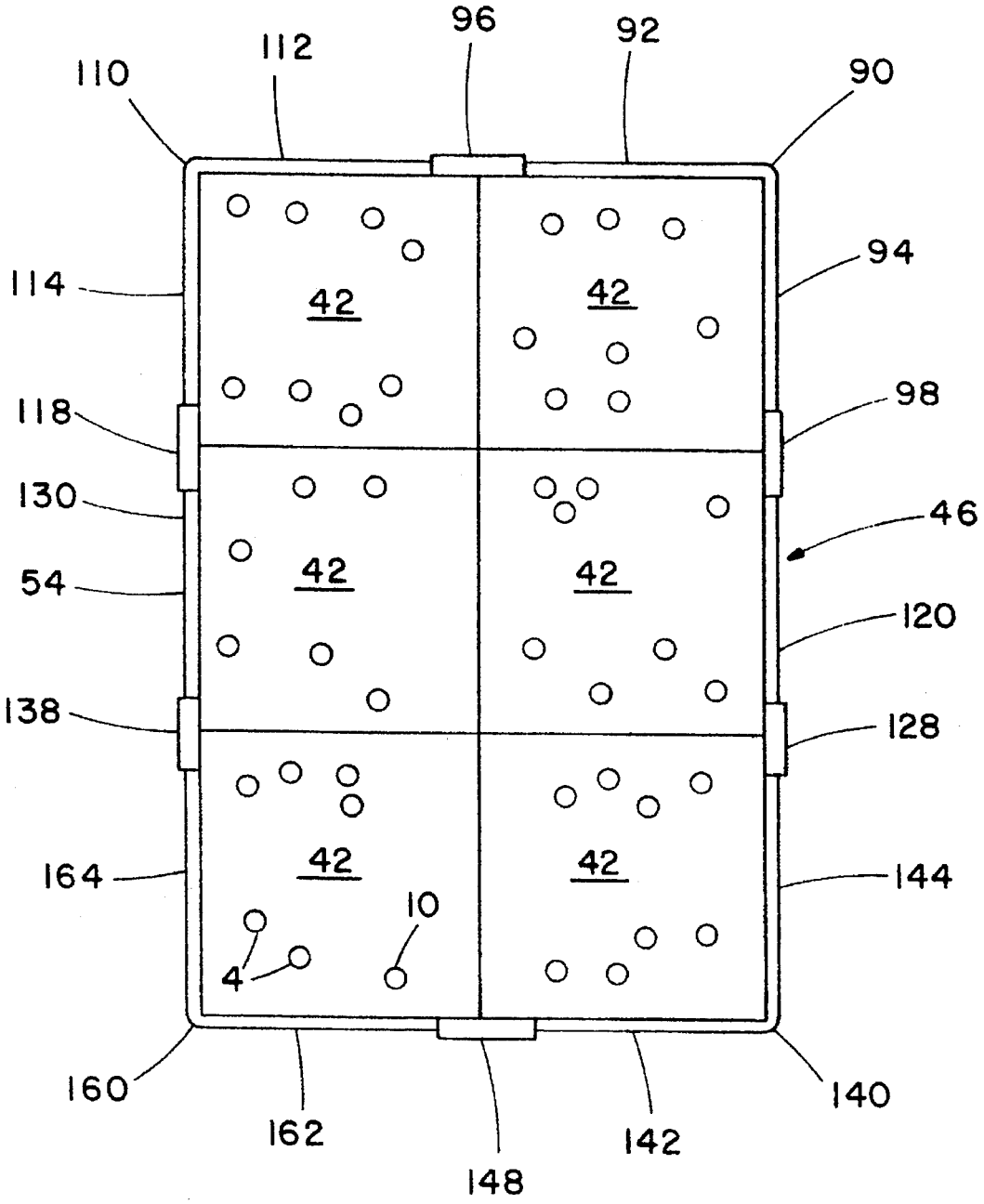
FIG. 8 is a bottom plan view of the modular innerspring assembly of FIG. 7.
Figure 9:
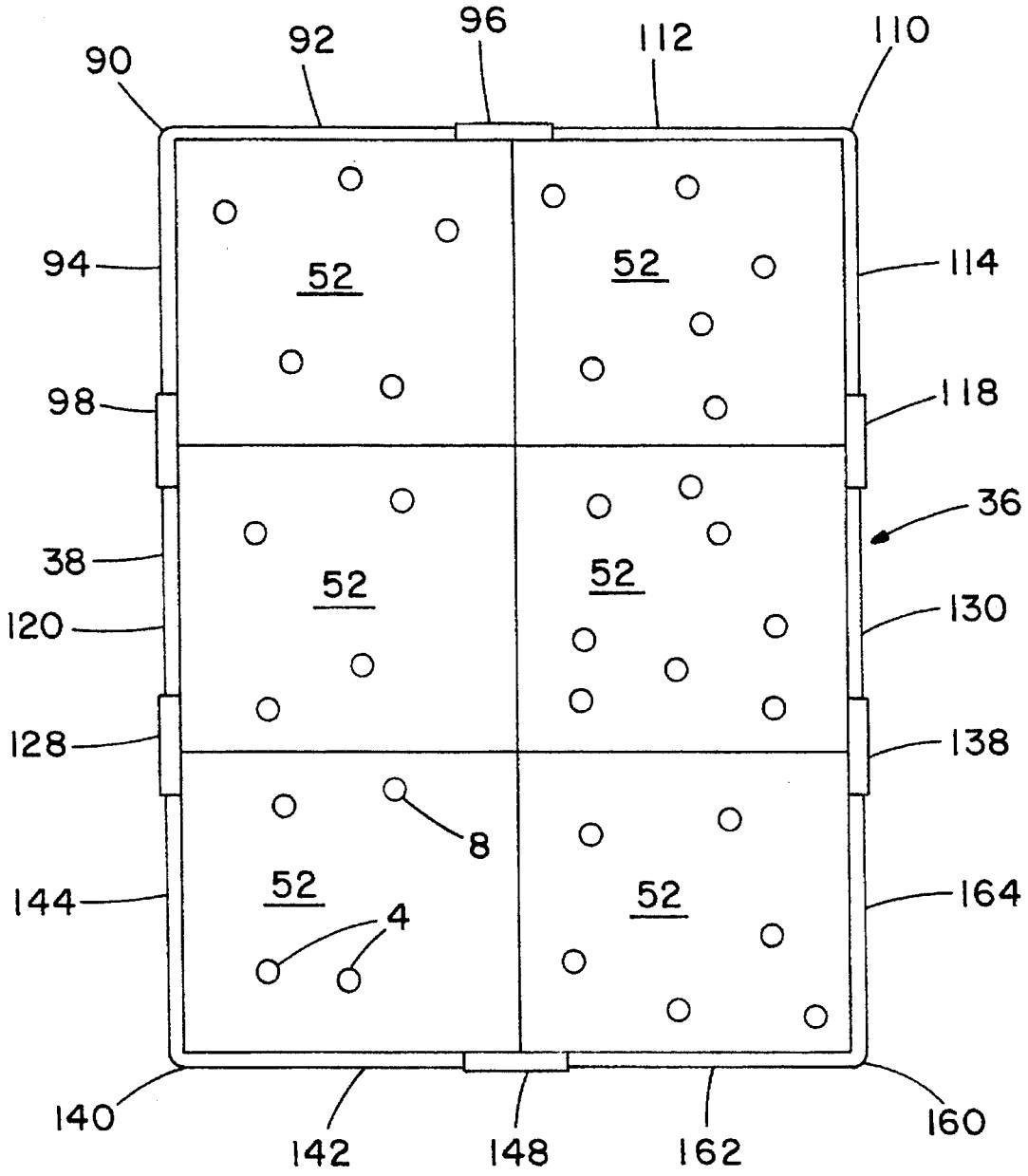
FIG. 9 is a top plan view of an assembled queen size modular innerspring assembly in accordance with this invention.
Figure 10:
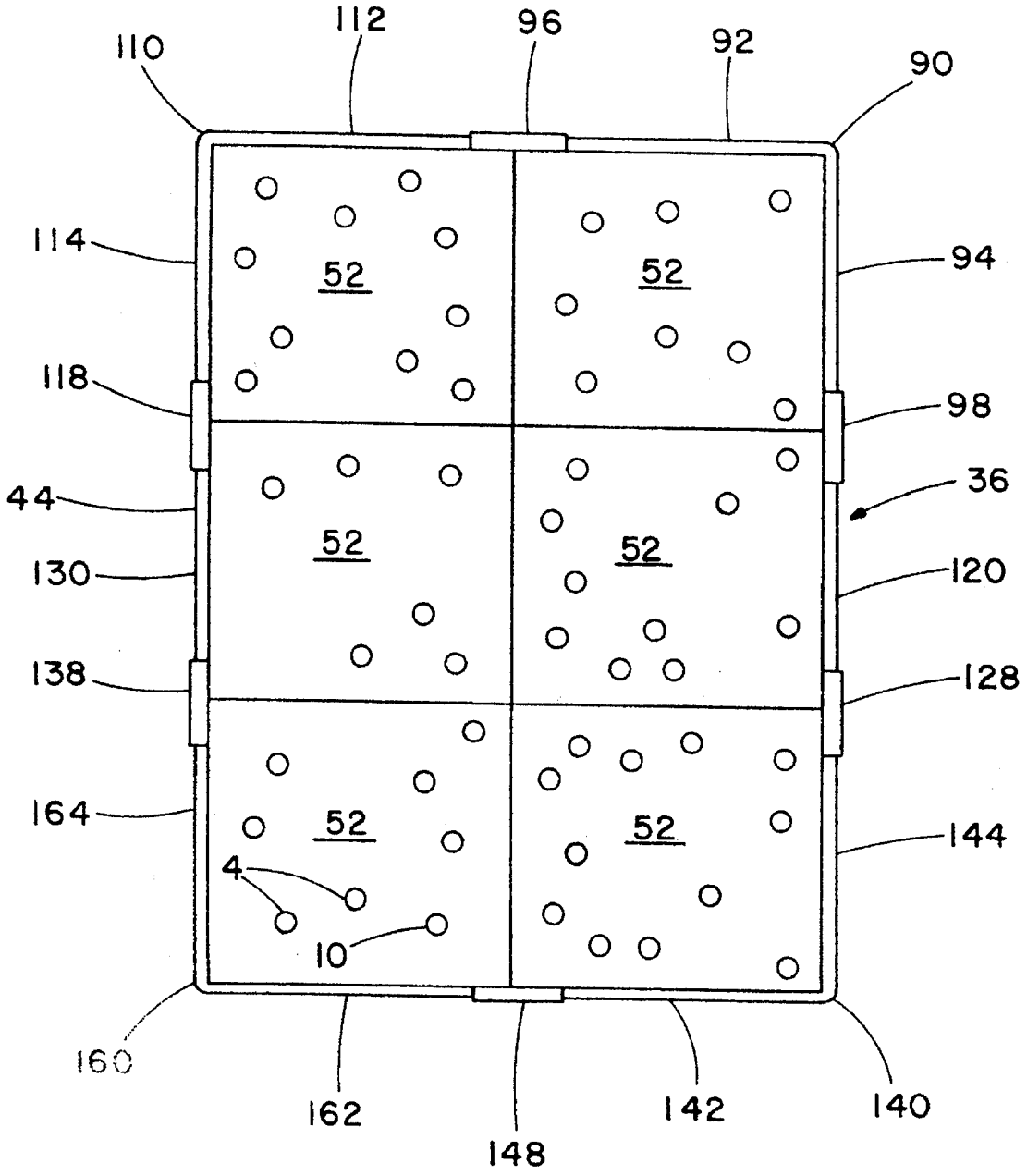
FIG. 10 is a bottom plan view of the modular innerspring assembly of FIG. 9.
Figure 11:
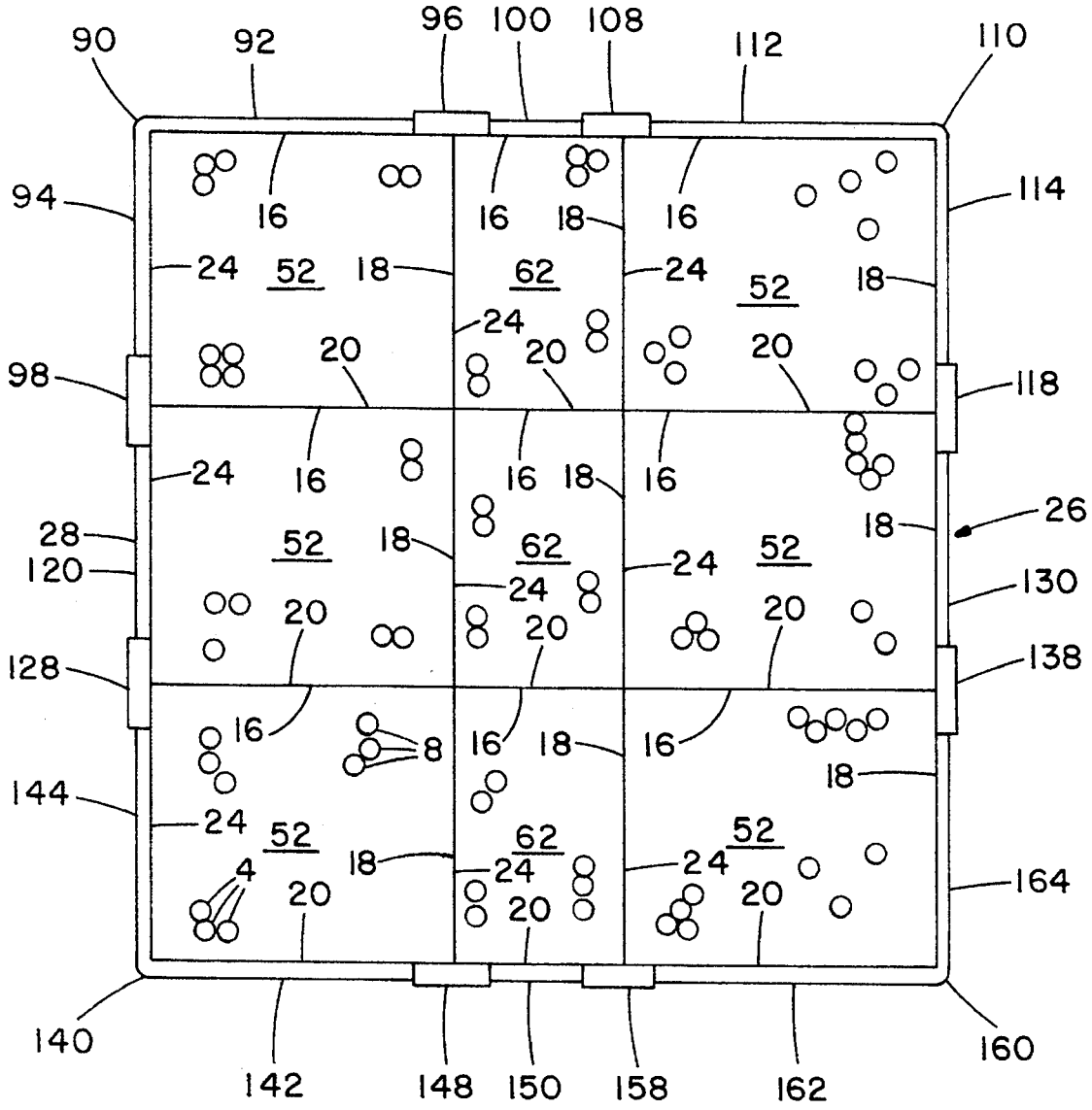
FIG. 11 is a top plan view of an assembled king size modular innerspring assembly in accordance with this invention.
Figure 12:
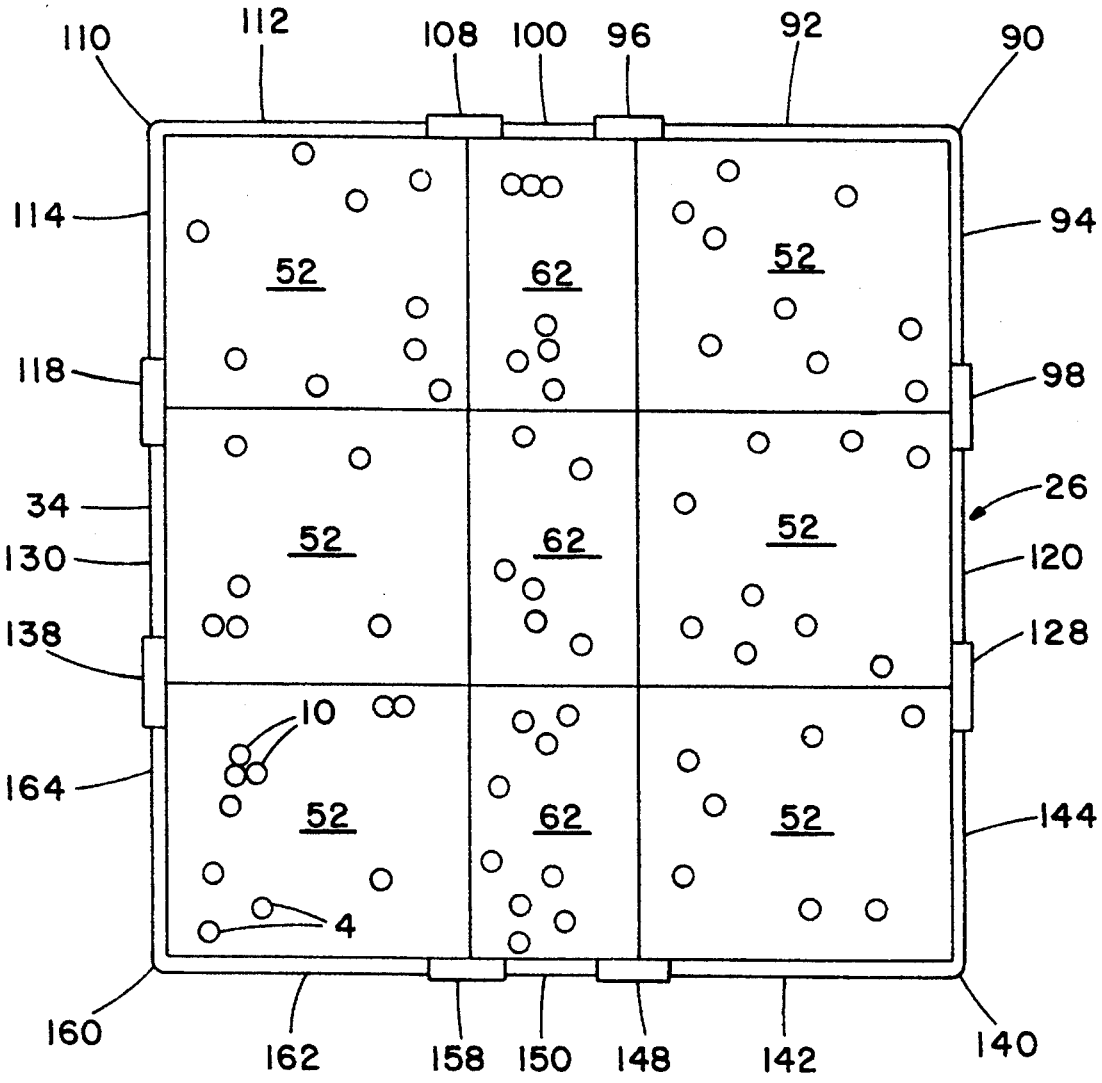
FIG. 12 is a bottom plan view of the modular innerspring assembly of FIG. 11.
Figure 13:
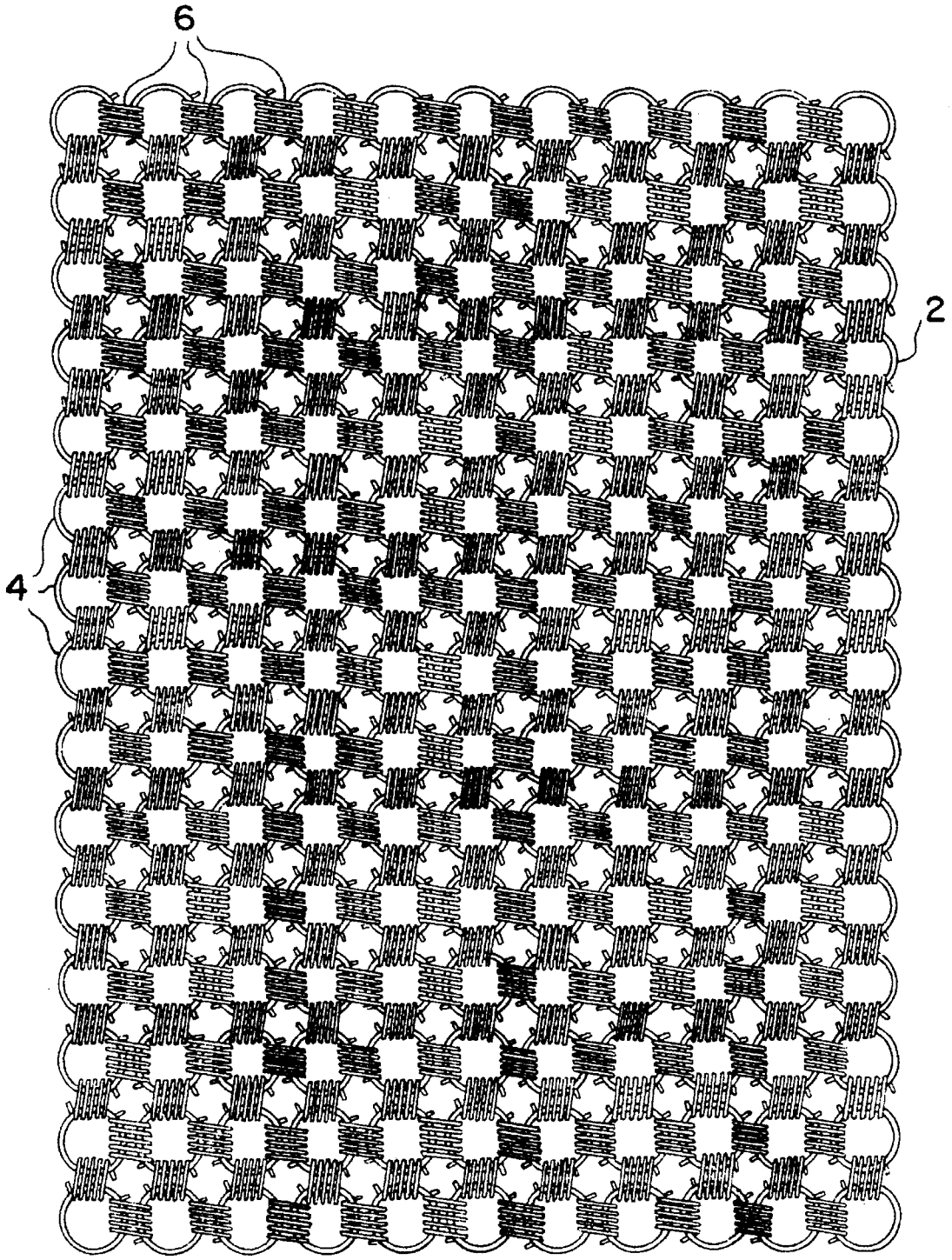
FIG. 13 is a top plan view of a single innerspring module in accordance with this invention shown before it has been connected to another module.
Figure 14:
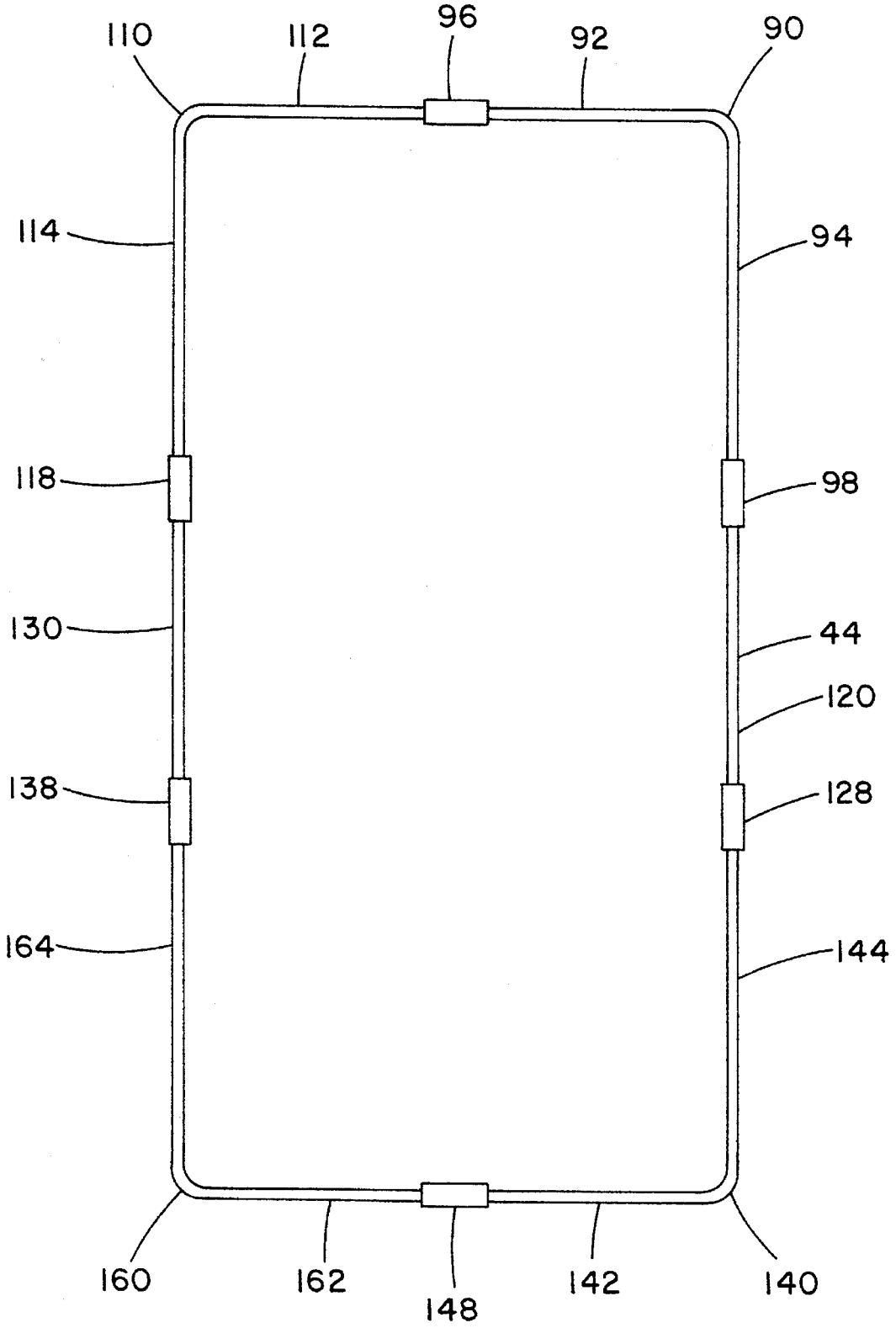
FIG. 14 is a plan view of the top peripheral border wire assembly for connection to the top coils of adjacent coil springs of assembled modules held in place within the boundary of the peripheral border wire assemblies.
Figure 15:
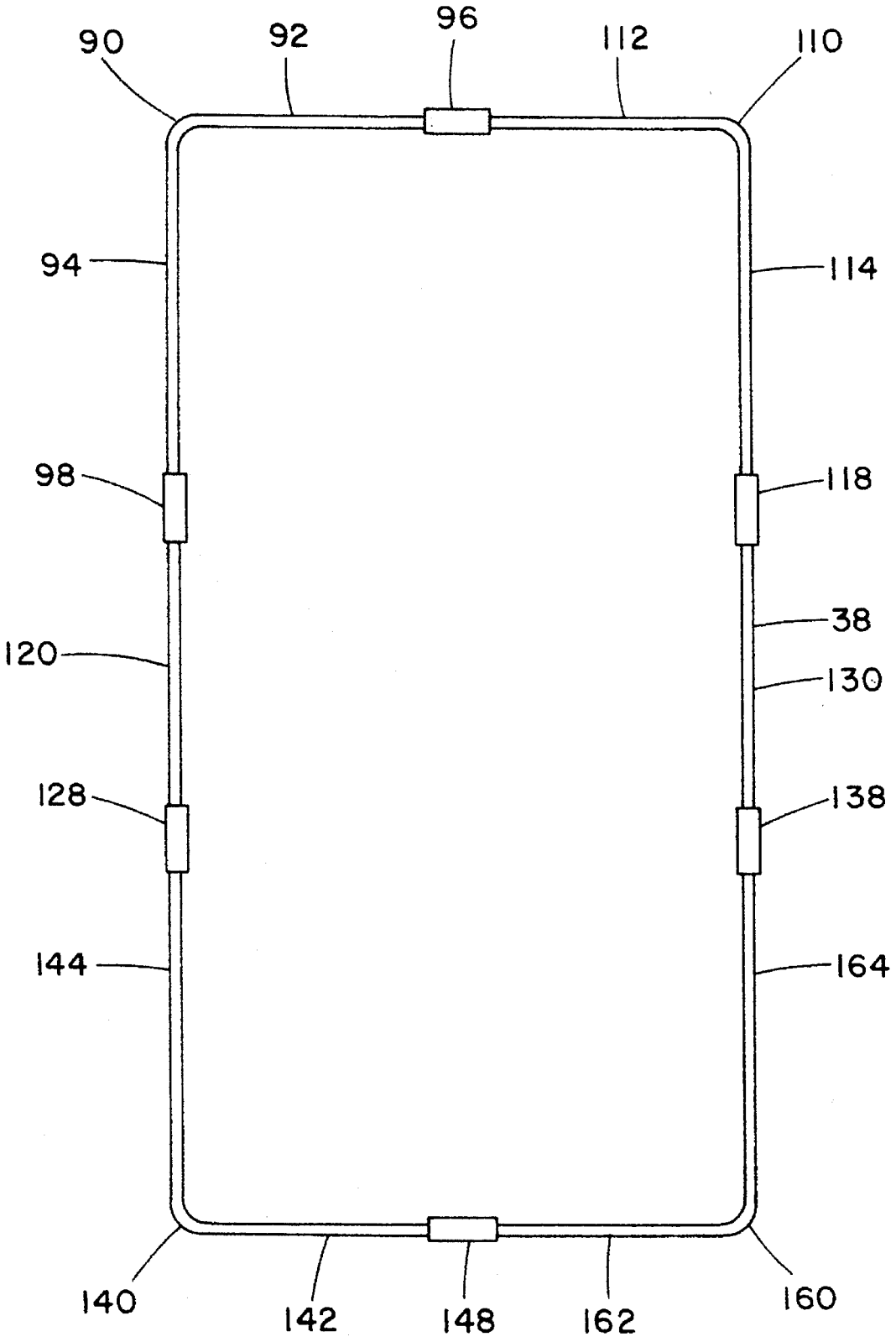
FIG. 15 is a plan view of the bottom peripheral border wire assembly for connection to the bottom coils of adjacent coil springs of the assembled modules.
Figure 16:
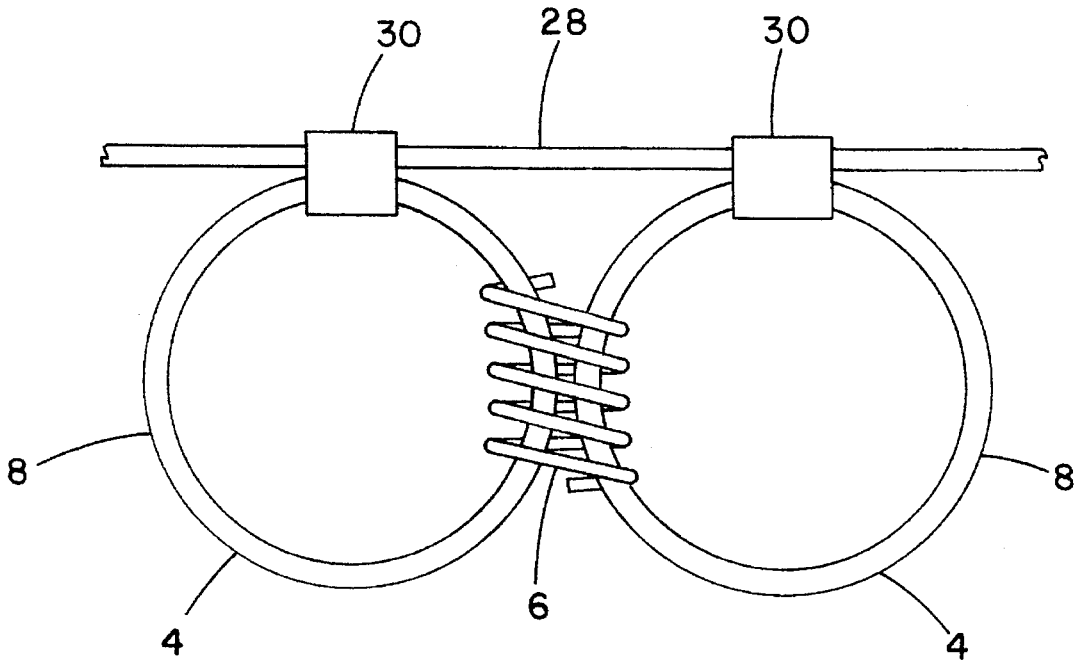
FIG. 16 is a top plan view of a segment of an innerspring module and of the top peripheral border wire assembly, enlarged to more clearly show the connection of the top coil of two coil springs to the top peripheral border wire assembly and to also show the connection of the coils to each other.
Figure 17:
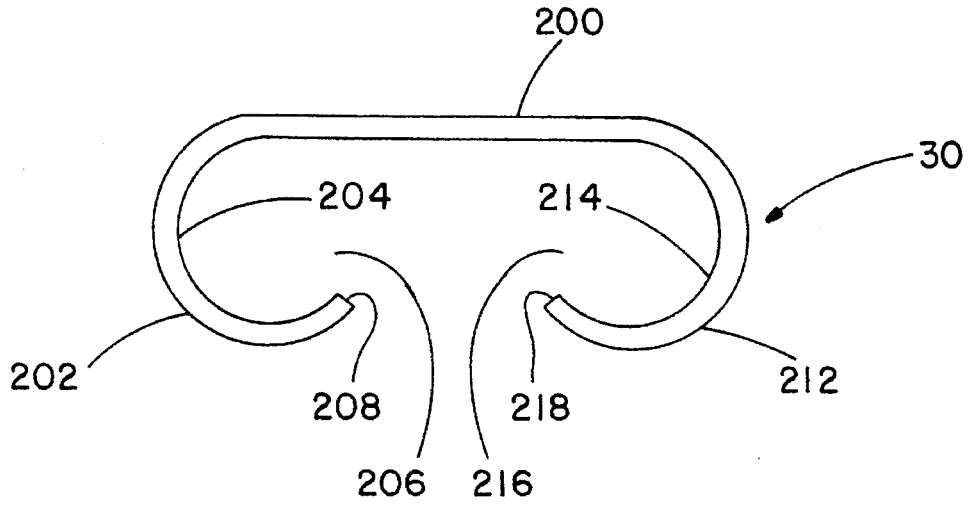
FIG. 17 is an elevation view, enlarged to more clearly show the construction of the connecting clips which secure the peripheral border wire assemblies to the coils of adjacent coil springs.
Figure 18:
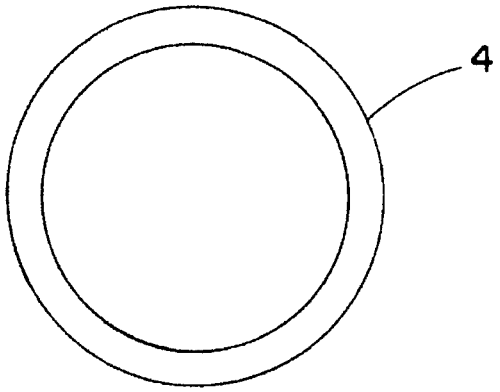
FIG. 18 is a top plan view of one of the coil springs of a modular innerspring module in accordance with this invention.
Figure 19:
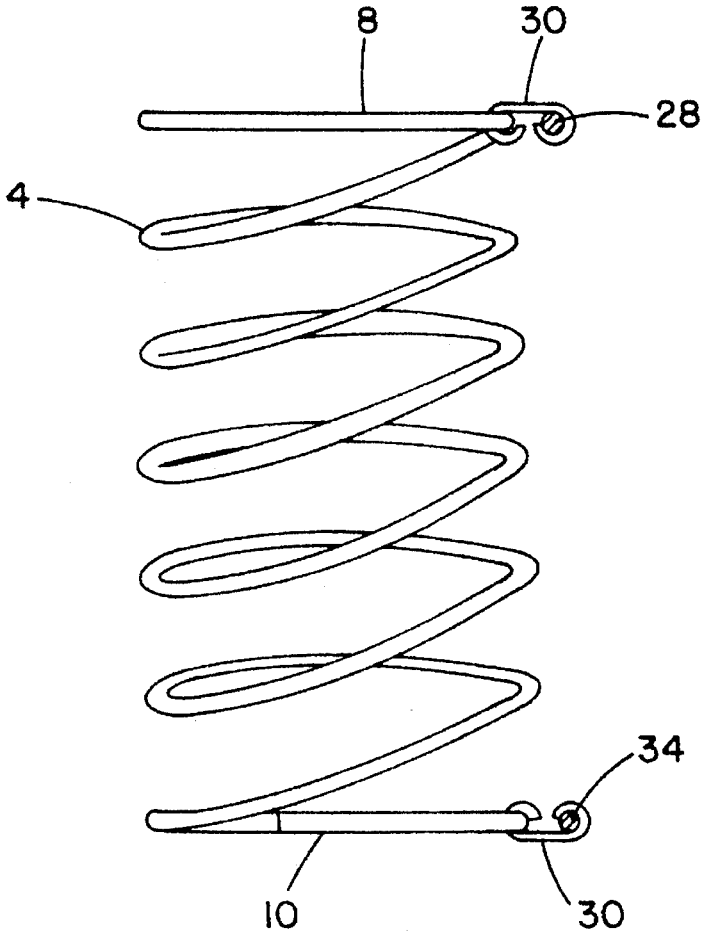
FIG. 19 is an elevation view of a coil spring as shown in FIG. 18, also showing its top and bottom coils connected to respective top and bottom peripheral border wire assemblies which are shown in section.
Figure 20:
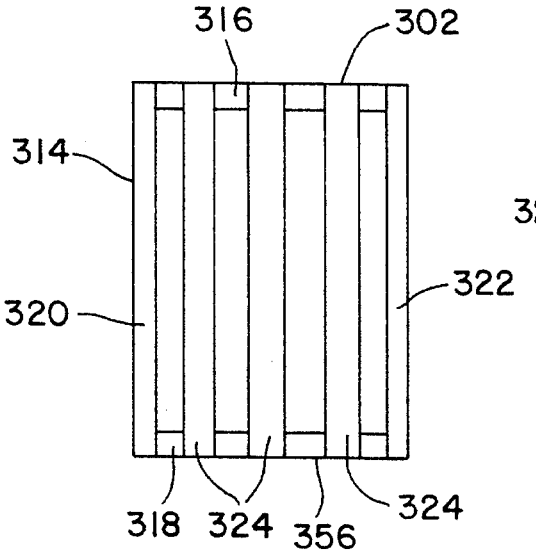
FIG. 20 is a bottom plan view of a box spring module needed to assemble a queen size modular box spring in accordance with this invention.
Figure 21:
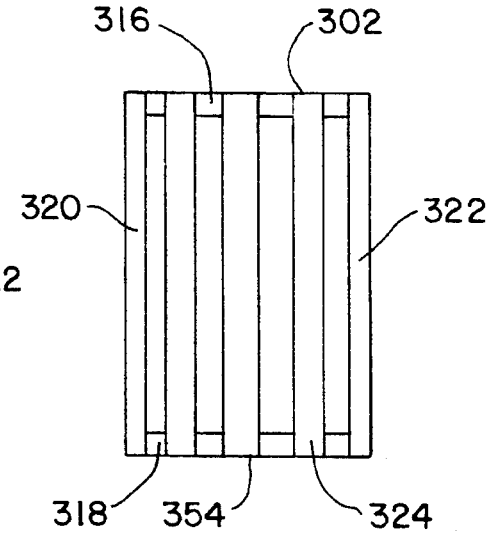
FIG. 21 is a bottom plan view of a box spring module needed to assemble a full size extra long modular box spring in accordance with this invention.
Figure 22:
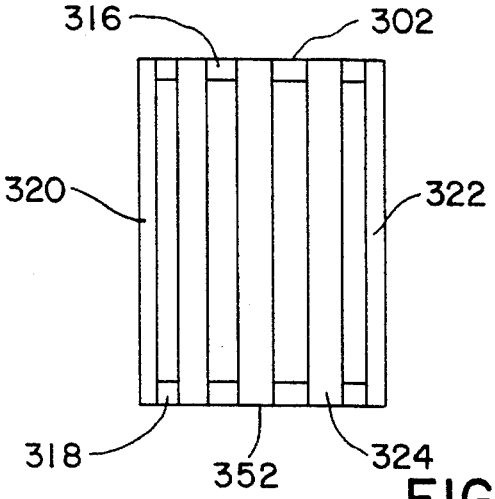
FIG. 22 is a bottom plan view of box spring module needed to assemble a full size modular box spring in accordance with this invention.
Figure 23:
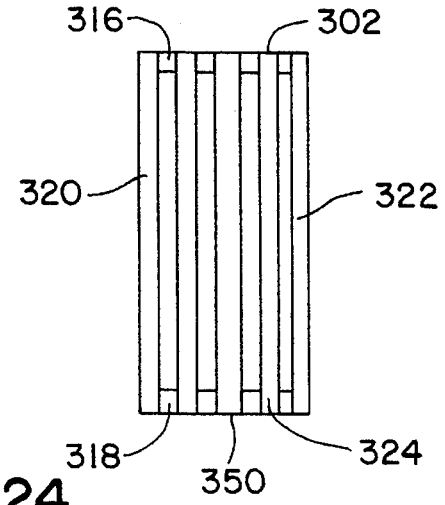
FIG. 23 is a bottom plan view of a box spring modular needed to assemble a twin size extra long modular box spring in accordance with this invention.
Figure 24:
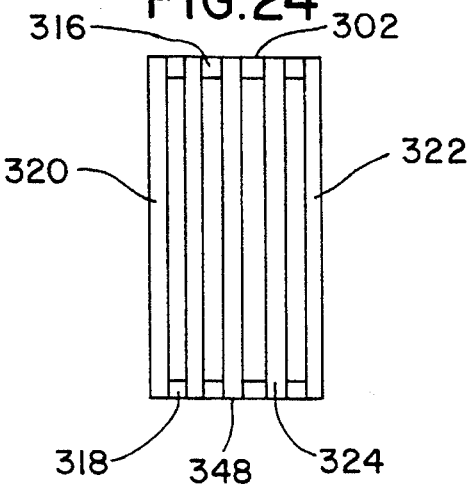
FIG. 24 is a bottom plan view of a box spring module needed to assemble a twin size modular box spring in accordance with this invention.
Figure 25:
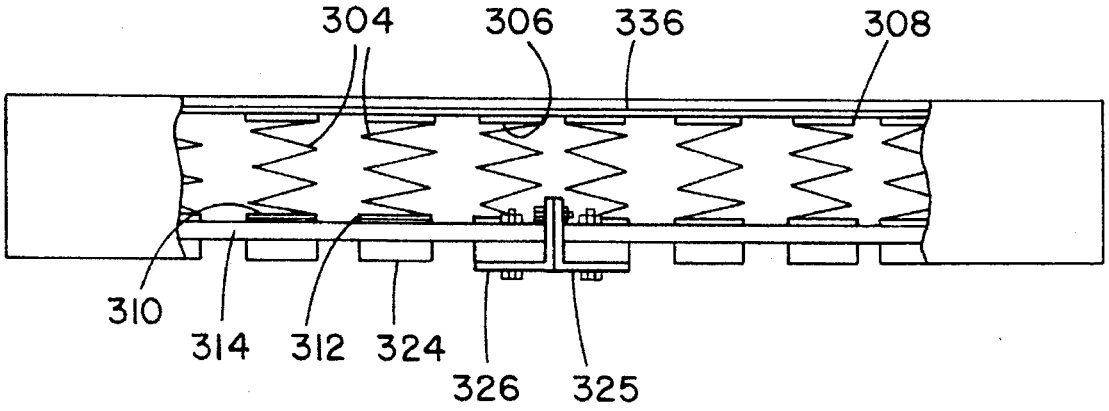
FIG. 25 is an end elevation view of an assembled modular box spring in accordance with this invention with a portion of the side wall covering broken away to illustrate the connection of two modules in side by side relationship.
Figure 26:
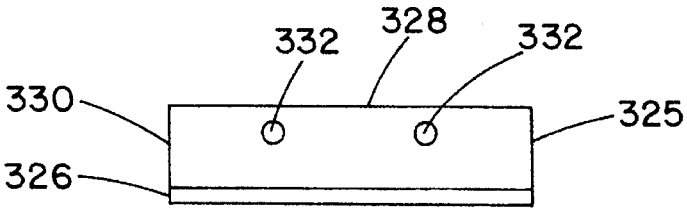
FIG. 26 is an elevation view from the front of an angle iron connecting member used to connect box spring modules together.
Figure 27:
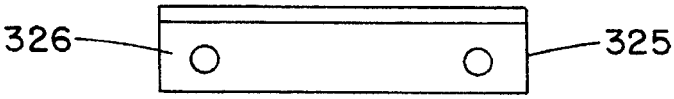
FIG. 27 is a plan view of the angle iron connecting member of FIG. 26.
Figure 28:
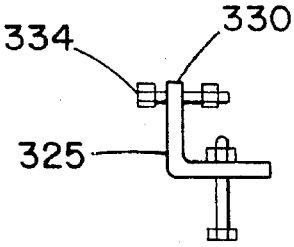
FIG. 28 is an end elevation view of the angle iron connecting members of 26.
Figure 29:
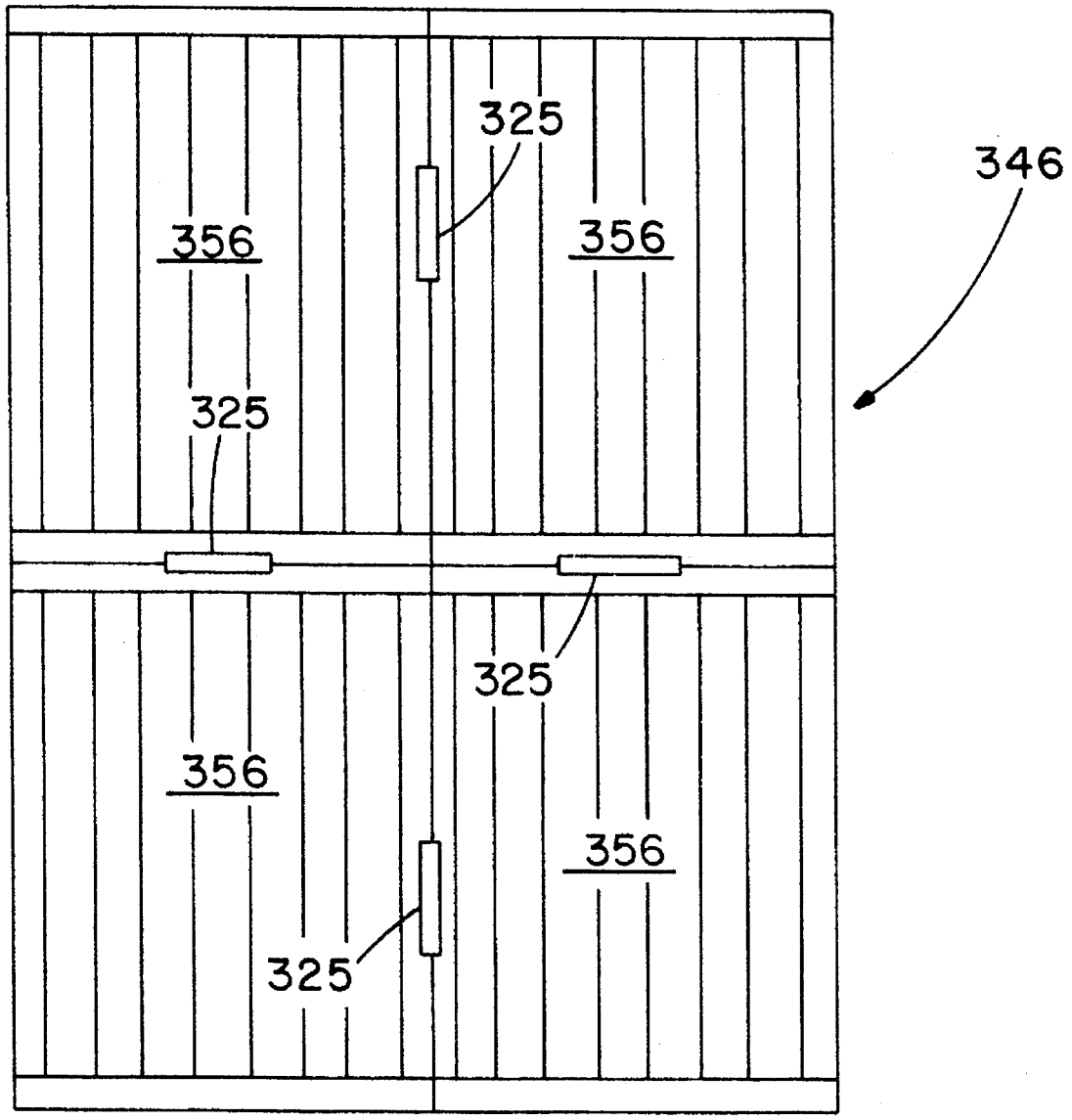
FIG. 29 is a plan view of an assembled queen size modular box spring in which the spring members and covering are removed to show the connection of the frame of each adjacent module.
Figure 30:
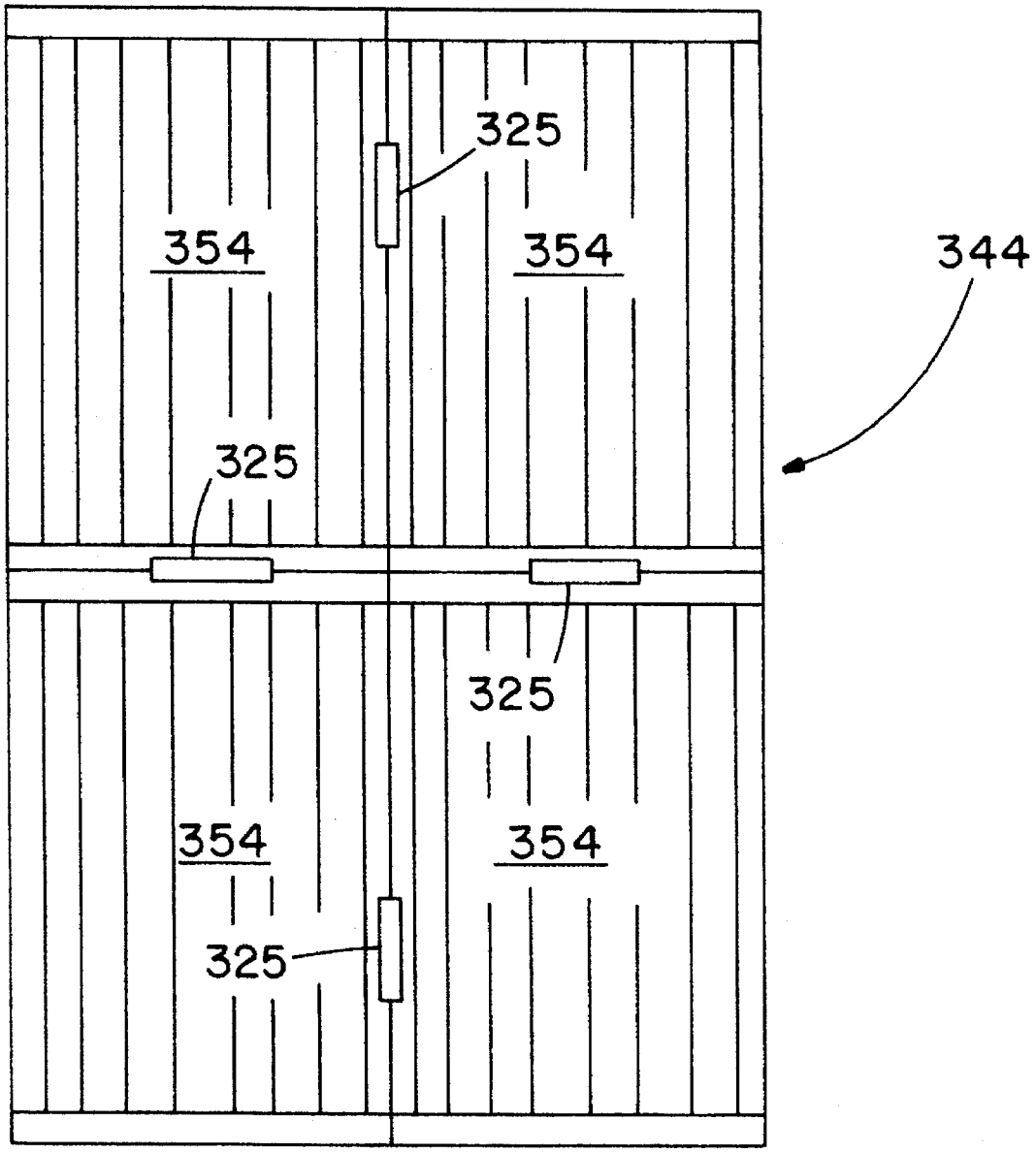
FIG. 30 is a plan view of an assembled full size extra long modular box spring in which the spring members and covering are removed to show the connection of the frames of each adjacent module.
Figure 31:
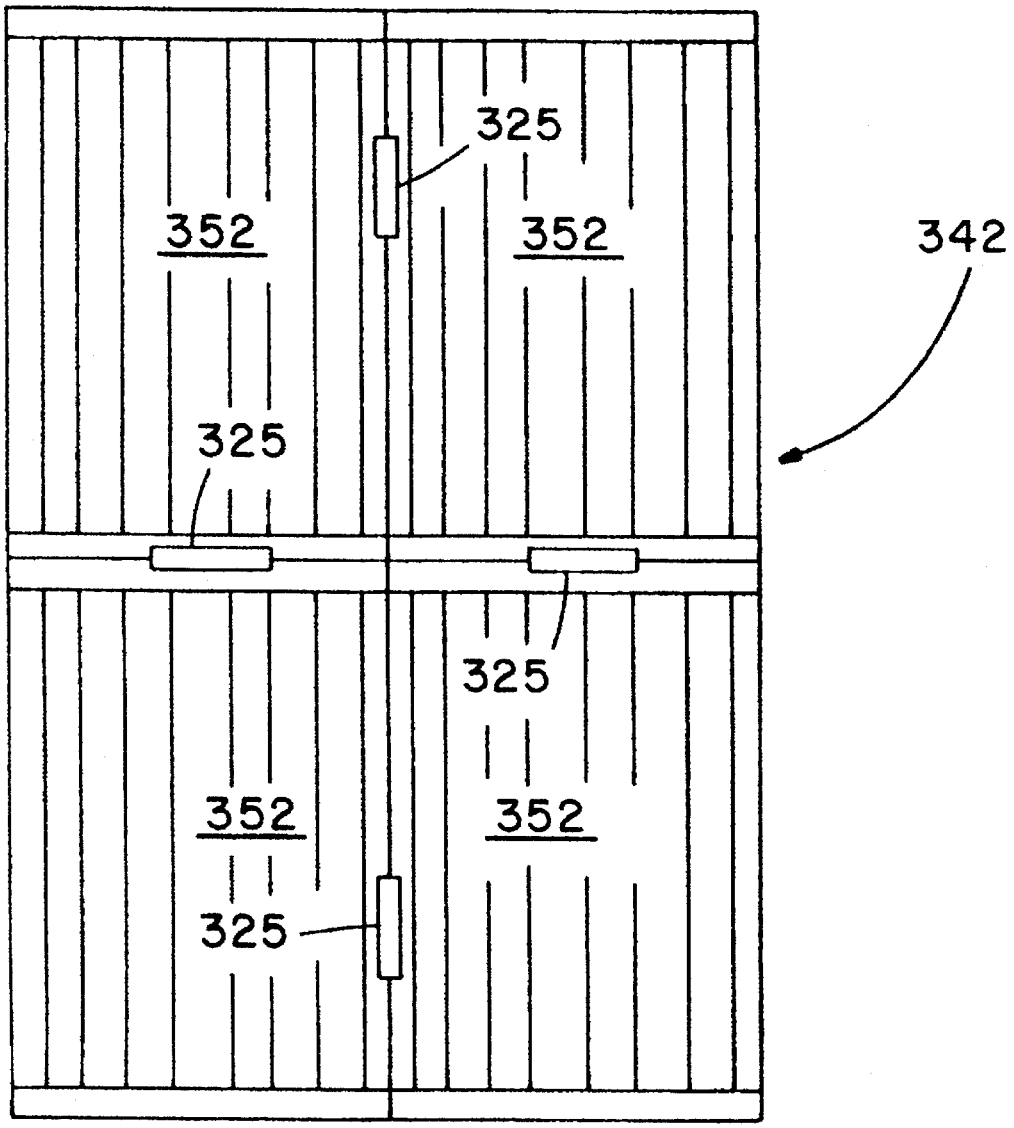
FIG. 31 is a plan view of an assembled full size modular box spring which the spring members and covering are removed to show the connection of the frames of each adjacent module.
Figure 32:
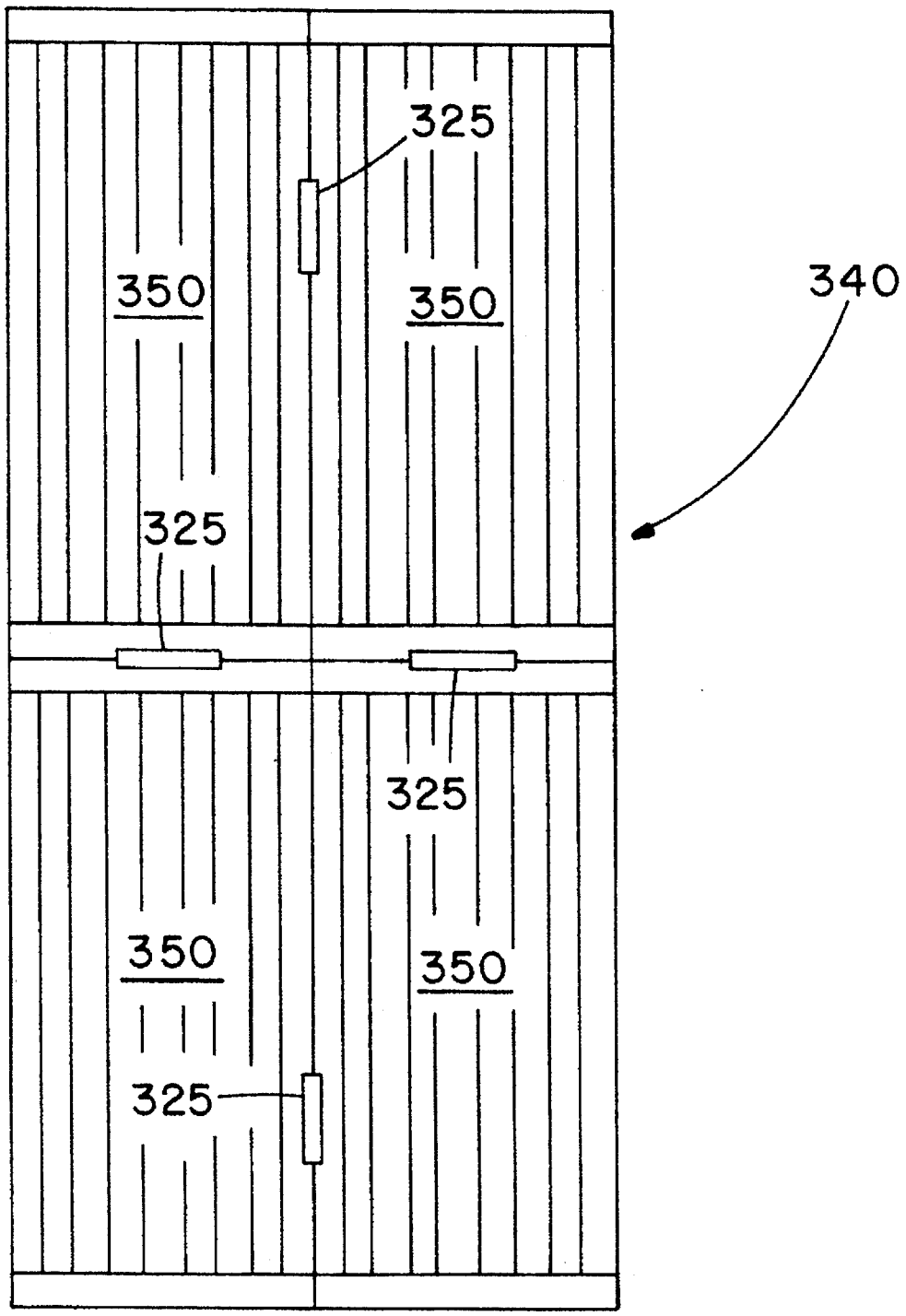
FIG. 32 is a plan view of an assembled twin size extra long modular box spring in which the spring members and covering are removed to show the connection of the frames of each adjacent module.
Figure 33:
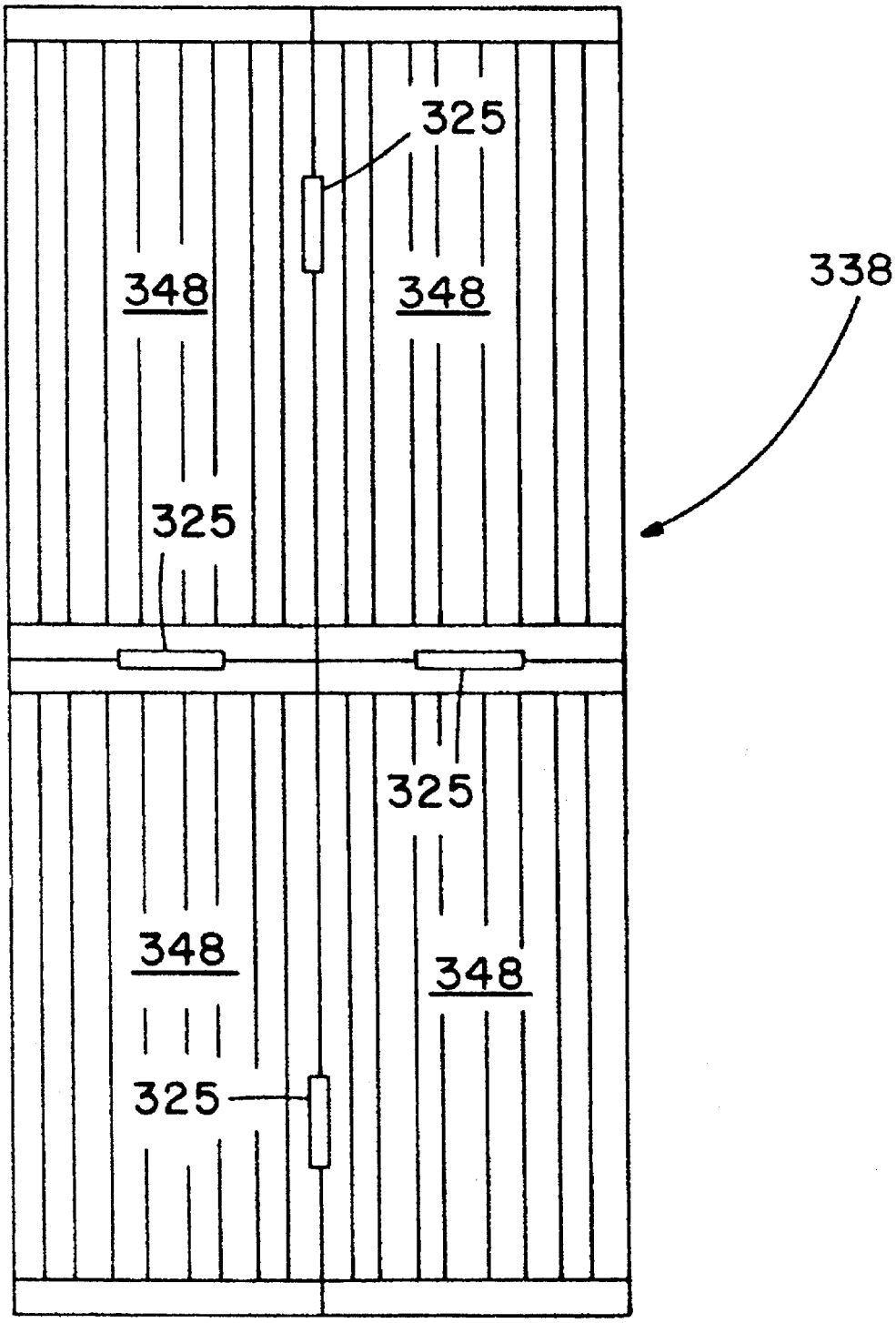
FIG. 33 is a plan view of an assembled twin size modular box spring in which the spring members and covering are removed to show the connection of the frames of each adjacent module.

A modular innerspring assembly in accordance with this invention comprises six separate modules of different sizes which can be put together in different combinations to make a king size innerspring assembly, a queen size innerspring assembly, a full innerspring assembly, a twin innerspring assembly, a twin innerspring assembly extra long and a full innerspring assembly extra long.

Each innerspring module 2 comprises a plurality of coil springs 4 in side by side relationship, each coil spring 4 secured to the other by helical wire fasteners 6 at their top coils 8 and their bottom coils 10.

First innerspring module 12 comprises a plurality of inter-connected coil springs 4 having a bearing surface dimension eighteen inches wide or laterally and twenty four inches long or longitudinally.

Second innerspring modules 22 comprises a plurality of inter-connected coil springs 4 having a bearing surface dimension eighteen inches wide or laterally and twenty six inches long or longitudinally.

Third innerspring modules 32 comprises a plurality of inter-connected coil springs 4 having a bearing surface dimension twenty-six inches wide or laterally and twenty four inches long or longitudinally.

Fourth innerspring module 42 comprises a plurality of inter-connected coil springs 4 having a bearing surface dimension twenty-six inches wide or laterally and twenty six inches long or longitudinally.

Fifth innerspring module 52 comprises a plurality of inter-connected coil springs 4 having a bearing surface dimension twenty nine inches wide or laterally and twenty six inches long or longitudinally.

Sixth innerspring module 62 comprises a plurality of inter-connected coil springs 4 having a bearing surface dimension sixteen inches wide or laterally and twenty six inches long or longitudinally.

Each of the innerspring modules 2 have a peripheral side wall 14, which includes a first side wall 16, a second side wall 18 extending at a right angle from one end of side wall 16, a third side wall 20 extending at a right angle from one end of side wall 18, and a fourth side wall 24 extending at a right angle from side wall 20 to join the other end of side wall 16.

To make a king size innerspring assembly 26 having a bearing surface dimension of seventy four inches wide or laterally and seventy eight inches long or longitudinally, six of the fifth innerspring modules 52 and three of the sixth innerspring modules 62 are connected together as follows.

Starting with a first innerspring module 52 at the upper left corner, a first innerspring module 62 is placed with its fourth side wall 24 adjacent the second side wall 18 of the first module 52. A second module 52 is placed with its fourth side wall 24 adjacent the second side wall 18 of the first module 62. A third module 52 is placed with its first side wall 16 adjacent the third side wall 20 of the first module 52. A second module 62 is placed with its first side wall 16 adjacent the third side wall 20 of the first module 62 and with its fourth side wall 24 adjacent the second side wall 18 of the third module 52. A fourth module 52 is placed with its first side wall 16 adjacent the third side wall 20 of the second module 52 and with its fourth side wall 24 adjacent the second side wall 18 of the second module 62. A fifth module 52 is placed with its first side wall 16 adjacent the third side wall 20 of the third module 52. A third module 62 is placed with its first side wall 16 adjacent the third side wall 20 of the second module 62 and with its fourth side wall 24 adjacent the second side wall 18 of the fifth module 52. A sixth module 52 is placed with its first side wall 16 adjacent the third side wall 20 of the fourth module 52 and with its fourth side wall 24 adjacent the second side wall 18 of the third module 62.

A first peripheral border wire assembly 28 is then secured to the top coils 8 of the coil springs 4 which are located along the outer periphery of the assembled king size innerspring assembly 26 by connecting clips 30. A second peripheral border wire assembly 34 is next secured to the bottom coils 10 of those coil springs 4 which are located along the outer periphery of the assembled kind size innerspring assembly 26 by connecting clips 30.

To make a queen size innerspring assembly 36 having a bearing surface dimension of fifty eight inches wide or laterally and seventy eight inches long or longitudinally, six of the fifth innerspring modules 52 are connected together as follows.

Starting with a first module 52 at the upper left corner, a second module 52 is placed with its fourth side wall 24 adjacent to the second side wall 18 of the first module 52. A third module 52 is placed with its first side wall 16 adjacent the third side wall 20 of the first module 52. A fourth module 52 is placed with its first side wall 16 adjacent the third side wall 20 of the second module 52 and with its fourth side wall 24 adjacent the second side wall 18 of the third module 52. A fifth module 52 is placed with its first side wall 16 adjacent the third side wall 20 of the third module 52. A sixth module 52 is placed with its first side wall 16 adjacent the third side wall 20 of the fourth module 52 and with its fourth side wall 24 adjacent the second side wall 18 of the fifth module 52.

A third peripheral border wire assembly 38 is then secured to the top coils 8 of the coil springs 4 which are located around the outer periphery of the assembled queen size innerspring assembly 36 by connecting clips 30. A fourth peripheral border wire assembly 44 is next secured to the bottom coils 10 of those coil springs 4 which are located along the outer periphery of the assembled queen size innerspring assembly 36 by connecting clips 30.

To make a full extra long size innerspring assembly 46 having a bearing surface dimension of fifty two inches wide or laterally and seventy eight inches long or longitudinally, six of the fourth innerspring modules 42 are connected together as follows.

Starting with a first module 42 at the upper left corner, a second module 42 is placed with its fourth side wall 24 adjacent to the second side wall 18 of the first module 42. A third module 42 is placed with its first side wall 16 adjacent to the third side wall 20 of the first module 42. A fourth module 42 is placed with its first side wall 16 adjacent to the third side wall 20 of the second module 42 and with its fourth side wall 24 adjacent to the second side wall 18 of the third module 42. A fifth module 42 is placed with its first side wall 16 adjacent to the third side wall 20 of the a third module 42. A sixth module 42 is placed with its first side wall 16 adjacent to the third side wall 20 of the fourth module 42 and with its fourth side wall 24 adjacent to the second side wall 18 of the fifth module 42.

A fifth peripheral border wire assembly 48 is then secured to the top coils 8 of the coil spring 4 which are located around the outer periphery of the assembled full size extra long innerspring assembly 46 by connecting clips 30. A sixth peripheral border wire assembly 54 is next secured to the bottom coils 10 of those coil springs 4 which are located along the outer periphery of the assembled full size extra long innerspring assembly 46 by connecting clip 30.

To make a full size innerspring assembly 56 having a bearing surface dimension of fifty two inches wide or laterally and seventy two inches long or longitudinally, six of the third innerspring modules 32 are connected together as follows.

Starting with the first module 32 at the upper left corner, a second module 32 is placed with its fourth side wall 24 adjacent to the second side wall 18 of the first module 32. A third module 32 is placed with its first side wall 16 adjacent to the third side wall 20 of the first module 32. A fourth module 32 is placed with its first side wall 16 adjacent to the third side wall 20 of the second module 32 and with its fourth side wall 24 adjacent to the second side wall 18 of the third module 32. A fifth module 32 is placed with its first side wall 16 adjacent to the third side wall 20 of the third module 32. A sixth module 32 is placed with its first side wall 16 adjacent to the third side wall 20 of the fourth module 32 and with its fourth side wall 24 adjacent to the second side wall 18 of the fifth module 32.

A seventh peripheral border wire assembly 58 is then secured to the top coils 8 of the coil springs 4 which are located around the outer periphery of the assembled full size innerspring assembly 56 by connecting clips 30. An eighth peripheral border wire assembly 64 is next secured to the bottom coils 10 of those coil springs 4 which are located along the outer periphery of the assembled full size innerspring assembly 56 by connecting clips 30.

To make a twin size extra long innerspring assembly 66 having a bearing surface dimension of thirty six inches wide or laterally and seventy eight inches long or longitudinally, six of the second innerspring modules 22 are connected together as follows.

Starting with the first module 22 at the upper left corner, a second module 22 is placed with its fourth side wall 24 adjacent to the second side wall 18 of the first module 22. A third module 22 is placed with its first side wall adjacent to the third side wall 20 of the first module 22. A fourth module 22 is placed with its first side wall 16 adjacent to the third side wall 20 of the second module 22 and with its fourth side wall 24 adjacent to the second side wall 18 of the third module 22. A fifth module 22 is placed with its first side wall 16 adjacent to the third side wall 20 of the third module 22. A sixth module 22 is placed with its first side wall 16 adjacent to the third side wall 20 of the fourth module 22 and with its fourth side wall 24 adjacent to the second side wall 18 of the fifth module 22.

A ninth peripheral border wire assembly 68 is then secured to the top coils 8 of the coil springs 4 which are located around the outer periphery of the assembled twin size extra long innerspring assembly 66 by connecting clips 30. A tenth peripheral border wire assembly 74 is next secured to the bottom coils 10 of those coil springs 4 which are located along the outer periphery of the assembled twin size extra long innerspring assembly 66 by connecting clips 30.

To make a twin size innerspring assembly 76 having a bearing surface dimension of thirty six inches wide or laterally and seventy two inches long or longitudinally, six of the first innerspring modules 12 are connected together as follows.

Starting with the first module 12 at the upper left corner, a second module 12 is placed with its fourth side wall 24 adjacent to the second side wall 18 of the first module 12. A third module 12 is placed with its first side wall 16 adjacent to the third side wall 20 of the first module 12. A fourth module 12 is placed with its first side wall 16 adjacent to the third side wall 20 of the second module 12 and with its fourth side wall 24 adjacent to the second side wall 18 of the third module 12. A fifth module 12 is placed with its first side wall 16 adjacent to the third side wall 20 of the third module 12. A sixth module 12 is placed with its first side wall 16 adjacent to the third side wall 20 of the fourth module 12 and with its fourth side wall 24 adjacent to the second side wall 18 of the fifth module 12.

An eleventh peripheral border wire assembly 78 is then secured to the top coils 8 of the coil springs 4 which are located around the outer periphery of the assembled twin size innerspring assembly 76 by connecting clips 30. A twelfth peripheral border wire assembly 84 is next secured to the bottom coils 10 of those coil springs 4 which are located along the outer periphery of the assembled twin size innerspring assembly 76 by connecting clips 30.

The border wire assemblies 28 and 34 each comprise the following components. A first L-shaped corner wire 90 having a short leg 92 is positioned with the short leg 92 adjacent the first side wall 16 of the first innerspring module 52 with an integrally joined long leg 94 extending normal to the short leg 92 and lying adjacent the fourth side wall 24 of the first module 52, the linear dimension of the short leg 92 corresponding to that of the first side wall 16 of the first module 52, the linear dimension of the long leg 94 corresponding to that of the fourth side wall 24 of first module 52. A sleeve member 96 snugly receives the free end of short leg 92 about half way into its bore and a similar sleeve member 98 snugly receives the free end of long leg 94 about half way into its bore.

A first straight wire 100 is positioned adjacent the first side wall 16 of the second module 52 and has a linear dimension corresponding to that of the first side wall 16 of the second module 52. One end of the straight wire 100 is snugly received about half way into the bore of sleeve member 96 to abut against the free end of short leg 90 received therein from the opposite end. A sleeve member 108 snugly receives the opposite end of the straight wire 100 about half way into its bore.

A second L-shaped corner wire 110 having a short leg 112 is positioned with short leg 112 adjacent the first side wall 16 of the third module 52 and having an integrally joined long leg 114 extending normal to the short leg 112 lying adjacent the second side wall 18 of the third module 52, the linear dimension of the short leg 112 corresponding to that of the first side wall 16 of the third module 52, the linear dimension of the long leg 114 corresponding to that of the second side wall 18 of the third module 52. The free end of the short leg 112 is snugly received in the bore of sleeve member 108 about halfway to abut against the facing end of the straight wire 100 received therein from the opposite end of sleeve member 108. A sleeve member 118 snugly receives the free end of the long leg 114 about half way into its bore.

A second straight wire 120 is positioned adjacent the fourth side wall 24 of the fourth module 52 and has a linear dimension corresponding to that of the fourth side wall 24 of the fourth module 52. One end of the straight wire 120 is snugly received about half way into the bore of sleeve member 98 to abut against the free end of long leg 94 of the first L-shaped corner wire which is received therein from the opposite end. A sleeve member 128 snugly receives the opposite free end of the second straight wire 120 about half way into its bore.

A third straight wire 130 is positioned adjacent the second side wall 18 of the sixth module 52 and has a linear dimension corresponding to that of the second side wall 18 of the sixth module 52. One end of the straight wire 130 is snugly received about half way into the bore of sleeve member 118 to abut against the free end of long leg 114 of the second L-shaped corner wire 110 which is received therein from the opposite end. A sleeve member 138 snugly receives the opposite free end of the third straight wire 130 about half way into its bore.

A third corner wire 140 having a short leg 142 lies with its short leg 142 adjacent the third side wall 20 of the seventh module 52, also having an integrally joined long leg 144 extending normal to the short leg 142 lying adjacent the fourth side wall 24 of the seventh module 52, the linear dimension of the short leg 142 corresponding to that of the third side wall 20 of the seventh module 52, the linear dimension of the long leg 144 corresponding to that of the fourth side wall 24 of the seventh module 52. A sleeve member 148 snugly receives the free end of short leg 142 about half way into its bore. The free end of long leg 144 is snugly received about half way into the bore of sleeve member 128 to abut against the free end of the second straight wire 120 which is received in the bore of sleeve member 128 from the opposite end.

A fourth straight wire 150 is positioned adjacent the third side wall 20 of the eighth module 52 and has a linear dimension corresponding to that of the third side wall 20 of the eighth module 52. One end of the straight wire 150 is snugly received about half way into the bore of sleeve member 148 to abut against the free end of short leg 142 of the third corner wire 140 which is received therein from the opposite end. A sleeve member 158 snugly receives the opposite free end of the fourth straight wire 150 about half way into its bore.

A fourth corner wire 160 having a short leg 162 is positioned with its short leg 162 adjacent the third side wall 20 of the ninth module 52, also having an integrally joined long leg 164 extending normal to the short leg 162 and lying adjacent the second side wall 18 of the ninth module 52, the linear dimension of the short leg 162 corresponding to that of the third side wall 20 of the ninth module 52, the linear dimension of the long leg 164 corresponding to that of the second side wall 18 of the ninth module 52. The free end of the short leg 162 of the fourth corner wire 160 is received about half way into the bore of sleeve member 158 to abut against the free end of the fourth straight wire 150 received therein from the opposite end. The free end of the long leg 164 of the fourth corner wire 160 is received about half way into the bore of sleeve member 138 to abut against the free end of the third straight wire 130 received therein from the opposite end.

Each of the sleeve members 96, 98, 108, 118, 128, 138, 148 and 158 are elongated, preferably between three and a half to four inches in length to receive the free ends of the respective corner wires 90, 110, 140 and 160 and of the respective straight wires 100, 120, and 130 and 150 about one and three quarters inches to two inches within the bores of the sleeve members. The free ends of the wire cannot slip out of the respective sleeve members when the module innerspring assembly in accordance with this invention has been assembled. The connecting clips 30 secure each of the wires making up the border wire assemblies 28 and 34 for king size innerspring assembly 26, border wire assemblies 38 and 44 for queen size innerspring assembly 36, border wire assemblies 48 and 54 for full size extra long innerspring assembly 46, border wire assemblies 58 and 64 for full size innerspring assembly 56, border wire assemblies 68 and 74 for twin size extra long innerspring assembly 66, and border wire assemblies 78 and 84 for twin size innerspring assembly 76 to the coil springs 4 which lie adjacent thereto.

The clips 30 each comprise a short relatively broad and slightly resilient metal strip 200 terminating at one end in a first arcuate hook 202 having a loop 204 having a radius whose configuration and dimension corresponds to that of the top coil 8 and bottom coil 10 of each respective coil spring 4 and having an entrance 206 opening to said loop of said arcuate hook having a dimension which is slightly less than the cross-sectional dimension of top coil 8 and bottom coil 10. The free end 208 of the first arcuate hook 202 is resilient enough to spread apart slightly to permit the coil 8 and coil 10 of coil spring 4 to pass through the entrance 206 and into the loop 204 of the arcuate hook 202, the free end 208 snaps back and the respective coil 8 or coil 10 is snugly received and securely held within the loop 204.

The clips 30 each terminate at the opposite end in a second arcuate hook 212 having a loop 214 having a radius whose configuration and dimension corresponds to that of the corner wires 90, 110, 140 and 160 and straight wires 100, 120, 130 and 150, and having an entrance 216 opening to said loop 214 having a dimension which is slightly less than the cross-sectional dimension of such wires. The free end 218 of the second arcuate hook 212 is resilient enough to spread apart slightly to permit a respective one of such wires to pass through the entrance 216 and into the loop 214 of the arcuate hook 212, the free end 218 snaps back and the respective one such wires is snugly received and securely held within the loop 214 of the second arcuate hook 212 of the clip 30.

The component parts of the border wire assemblies 28 and 34 around the upper and lower peripheral edges of the king size innerspring assembly 26 have been described in detail above. The components for the border wire assemblies of the queen, full extra long, full, twin extra long and twin are similar, except that a first straight wire corresponding to straight wire 100 and a fourth straight wire corresponding to straight wire 150 needed for the king at each opposite end where they extend laterally are not needed for the queen, full extra long, full, twin extra long and twin. The king is made up of nine innerspring modules 2, comprising three lateral rows of three in each row. Each of the others is made up of six innerspring modules 2, comprising three lateral rows of only two in each row. Also, the dimension of the corner wires and straight wires for each of the various sizes of the border wire assemblies for the completed modular innerspring assemblies in accordance with this invention vary to correspond in linear dimension to that of the particular innerspring module 2 to which each corner wire and straight wire will be placed adjacent and connected by the connecting clips 30.

It is not necessary therefor to describe each of the component parts of the other border wire assemblies 38 and 44 (queen size), 48 and 54 (full size extra long), 58 and 64 (full size), 68 and 74 (twin size extra long) and 78 and 84 (twin size) in the detail needed to describe one of the sets of border wire assemblies, namely border wire assemblies 28 and 34 for the king size innerspring assembly 26 which is the one selected for detail description as set forth above.

A modular box spring assembly is also provided as the foundation for the modular innerspring assemblies in accordance with this invention. The modular box spring assembly comprises five separate box spring modules 302 of different sizes which can be put together in different combinations to make a twin size box spring, a twin size extra long box spring, a full size box spring, a full size extra long box spring, and a queen size box spring. For a king size mattress, two twin size extra long box springs are utilized.

Each box spring module 302 comprises a plurality of Z-shaped wire springs 304 in side by side relationship, each having a first or upper laterally extending leg 306 terminating in a free end 308 and a second or lower laterally extending leg 310 terminating in a free end 312, each laterally extending leg 306 and 310 being integrally formed as part of the Z-shaped wire spring 304.

Each box spring module 302 also comprises a base frame 314, preferably of wood, including a first laterally extending end strip 316 across one end, a second laterally extending end strip 318 across the opposite end, a first longitudinally extending side strip 320 connected at one end to one end of first lateral end strip 316 and at its other end to one end of second lateral end strip 318, and a second longitudinally extending side strip 322 connected at one end to the other end of first lateral end strip 316 and at its other end to the other end of second lateral end strip 318. A plurality of longitudinally extending support slats 324 are spaced apart between side strips 320 and 322, each secured at one end to the first lateral end strip 316 and at the other end to the second lateral end strip 318.

An elongated L-shaped angle iron 326, comprising a first or horizontal leg 326 and an integrally joined second or vertical leg 328, has its first or horizontal leg 326 bolted to the underside of the second longitudinally extending side strip 322 of each box spring module 302, and to the underside of the second laterally extending end strip 318 of each box spring module 302. When so bolted, the second or vertical leg 328 of the angle iron 326 has a projecting portion 330 which extends slightly above the plane of the upper surface of the longitudinally extending side strip 322 and the laterally extending end strip 318 to which they are respectively secured. A pair of apertures 332 extend through the upwardly projecting portion 330.

The angle irons 326 are positioned on each longitudinally extending side strip 322 and on each laterally extending and strip 318 so they come into full facing relationship with the respective side and end angle irons of other box spring modules 302 of corresponding dimensions when they are placed in full facing relationship with their respective second longitudinally extending side strips 322 adjacent each other, or with their respective second laterally extending end strips 318 adjacent each other. When so placed, the apertures 332 of the angle irons 326 which are then in full facing relationship will be in registration to receive connecting bolts 334 therethrough to secure the adjacent box spring modules 302 together.

A top layer 336 of mesh material is placed over the top of each box spring module 30.

The first or upper laterally extending leg 306 of each Z-shaped wire spring 304 is secured to the top layer 336 by a clip and the second or lower laterally extending leg 310 of each Z-shaped wire spring 304 is secured to respective ones of the longitudinally extending side strips 320 and 322 or to respective ones of the longitudinally extending support slats 324, which respective ones of the Z-shaped wire springs 304 are facing and bearing against.

The five box spring modules 302 of different sizes needed to put together a twin size modular box spring 338, a twin size extra long modular box spring 340, a full size modular box spring 342, a full size extra long modular box spring 344 and a queen size modular box spring 346 in accordance with this invention are described as follows. For a king size mattress, two twin size extra long modular box springs 340 are placed side by side to support a king size innerspring mattress.

A twin size box spring module 348 has a width or lateral dimension of eighteen inches and a length or longitudinal dimension of thirty seven inches. Two of such box spring modules 348 are placed in side by side relationship with their respective second longitudinal side strips 322 adjacent each other, then secured together by bolts through the apertures 332 of the respective angle irons 326. A third box spring module 348 is placed with its second laterally extending end strip 318 adjacent the second laterally extending end strip 318 of one of the first two box spring modules 348 with the second longitudinally extending side strip 322 of the third box spring module 348 in line with the same side strip 322 of the box spring module 348 against which it is placed adjacent. A fourth box spring module 348 is then placed with its second laterally extending end strip 319 adjacent the second laterally extending end strip 318 of the other of the first two box spring modules 348 with its second longitudinally extending side strip 322 then being adjacent the second longitudinally extending side strip 322 of the third box spring module 348. The third and fourth box spring modules 348 are then secured to respective ones of the first two box spring modules 348 and to each other by bolts through the apertures 332 of the respective angle irons 326 which are at such time in full facing relationship one with another. This completes the assembly of a twin size modular box spring 338.

A twin size extra long box spring module 350 has a width or lateral dimension of eighteen inches and a length or longitudinal dimension of thirty nine inches. Two of such box spring modules 350 are placed in side by side relationship with their respective second longitudinal side strips 322 adjacent each other, then secured together by bolts through the aperture 332 of the respective angle irons 326. A third box spring module 350 is placed with its second laterally extending end strip 318 adjacent the second laterally extending end strip 318 of one of the first two box spring modules 350 with the second longitudinally extending side strip 322 of the third box spring module 350 in line with the same side strip 322 of the box spring module 350 against which it is placed adjacent. A fourth box spring module 350 is then placed with its second laterally extending end strip 318 adjacent the second laterally extending end strip 318 of the other of the first two box spring modules 350 with its second longitudinally extending side strip 322 then being adjacent the second longitudinally extending side strip 322 of the third box spring module 350. The third and fourth box spring modules 350 are then secured to respective ones of the first two box spring modules 350 and to each other by bolts through the apertures 332 of the respective angle irons 326 which are at such time in full facing relationship one with another. This completes the assembly of a twin size extra long modular box spring 340.

A full size box spring module 352 has a width or lateral dimension of twenty six inches and a length or longitudinal dimension of thirty seven inches. Two of such box spring modules 352 are placed in side by side relationship with their respective second longitudinal side strips 322 adjacent each other, then secured together by bolts through the aperture 332 of the respective angle irons 326. A third box spring module 352 is placed with its second laterally extending end strip 318 adjacent the second laterally extending end strip 318 of one of the first two box spring modules 352 with the second longitudinally extending side strip 322 of the third box spring module 352 in line with the same side strip 322 of the box spring module 352 against which it is placed adjacent. A fourth box spring module 352 is then placed with its second laterally extending end strip 318 adjacent the second laterally extending end strip 318 of the other of the first two box spring modules 352 with its second longitudinally extending side strip 322 then being adjacent the second longitudinally extending side strip 322 of the third box spring module 352. The third and fourth box spring modules 352 are then secured to respective ones of the first two box spring modules 352 and to each other by bolts through the apertures 332 of the respective angle irons 326 which are at such time in full facing relationship one with another. This completes the assembly of a full size modular box spring 342.

A full size extra long box spring module 354 has a width or lateral dimension twenty six inches and a length or longitudinal dimension of thirty nine inches. Two of such box spring modules 354 are placed in side by side relationship with their respective second longitudinal side strips 322 adjacent each other, then secured together by bolts through the aperture 332 of the respective angle irons 326. A third box spring module 354 is placed with its second laterally extending end strip 318 adjacent the second laterally extending end strip 318 of one of the first two box spring modules 354 with the second longitudinally extending side strip 322 of the third box spring module 354 in line with the same side strip 322 of the box spring module 354 against which it is placed adjacent. A fourth box spring module 354 is then placed with its second laterally extending end strip 318 adjacent the second laterally extending end strip 318 of the other of the first two box spring modules 354 with its second longitudinally extending side strip 322 then being adjacent the second longitudinally extending side strip 322 of the third box spring module 354. The third and fourth box spring modules 354 are then secured to respective ones of the first two box spring modules 354 and to each other by bolts through the apertures 332 of the respective angle irons 326 which are at such time in full facing relationship one with another. This completes the assembly of a full size extra long modular box spring 344.

A queen size box spring module 356 has a width or lateral dimension of twenty nine inches and a length or longitudinal dimension of thirty nine inches. Two of such box spring modules 356 are placed in side by side relationship with their respective second longitudinal side strips 322 adjacent each other, then secured together by bolts through the aperture 332 of the respective angle irons 326. A third box spring module 356 is placed with its second laterally extending end strip 318 adjacent the second laterally extending end strip 318 of one of the first two box spring modules 356 with the second longitudinally extending side strip 322 of the third box spring module 356 in line with the same side strip 322 of the box spring module 356 against which it is placed adjacent. A fourth box spring module 356 is then placed with its second laterally extending end strip 318 adjacent the second laterally extending end strip 318 of the other of the first two box spring modules 356 with its second longitudinally extending side strip 322 then being adjacent the second longitudinally extending side strip 322 of the third box spring module 356. The third and fourth box spring modules 356 are then secured to respective ones of the first two box spring modules 356 and to each other by bolts through the apertures 332 of the respective angle irons 326 which are at such time in full facing relationship one with another. This completes the assembly of a queen size modular box spring 346.

I claim:

1. A modular innerspring assembly comprising a plurality of innerspring modules wherein each one of said plurality of innerspring modules is initially made as a separate and independent structure, each one of said innerspring modules in said plurality thereof comprising a plurality of springs in side-by-side relationship each terminating at one end in a first spring end piece and at the opposite end in a second spring end piece, a peripheral module boundary around each one of the said innerspring modules, said plurality of springs including a peripheral boundary plurality of springs in side-by-side relationship located in and extending around said peripheral module boundary of each one of said innerspring modules, first connecting means to connect adjacent ones of said first spring end pieces of adjacent ones of said springs to each other, second connecting means to connect adjacent ones of said second spring end pieces of adjacent ones of said springs to each other, said peripheral module boundary of each one of said innerspring modules includes a first laterally extending side, a first longitudinally extending side extending from one end of said first laterally extending side normal thereto and terminating at an opposite end, a second laterally extending side extending from said opposite end of said first longitudinally extending side normal thereto in the same direction as said first laterally extending side and terminating at an opposite end a second longitudinally extending side extending from said opposite end of said second laterally extending side normal thereto to said other end of said first laterally extending side, a first one of said innerspring modules being placed with said first longitudinally extending side adjacent to a second longitudinally extending side of a second one of said innerspring modules, including said second one of said innerspring modules having said second longitudinally extending side, a first boundary wire assembly extending completely around one peripheral edge of said modular innerspring assembly at the level of said first spring end pieces of said springs, a second boundary wire assembly extending completely around the other peripheral edge of said modular innerspring assembly at the level of said second spring end pieces of said springs, third connecting means to connect said first boundary wire assembly to adjacent ones of said first spring end pieces of said springs and fourth connecting means to connect said second boundary wire assembly to adjacent ones of said second spring end pieces of said springs, wherein each spring in each peripheral boundary plurality of springs around the periphery of said innerspring modules is the same as each other around all sides of such periphery, including their respective first and second end pieces, whereby any side of any one of said innerspring modules as desired may be placed interchangeably adjacent said first and second boundary wire assemblies and connected thereto by said third and fourth connecting means respectively.

2. A modular innerspring assembly as set forth in claim 1, wherein said plurality of innerspring modules includes a third one of said innerspring modules, said third one of said innerspring modules having a first laterally extending side adjacent said second laterally extending side of said first one of said innerspring modules.

3. A modular innerspring assembly as set forth in claim 2, wherein said plurality of innerspring modules includes a fourth one of said innerspring modules, said fourth one of said innerspring modules having a first laterally extending side adjacent said second laterally extending side of said second one of said innerspring modules and having its said second longitudinally extending side adjacent said first longitudinally extending side of said third one of said innerspring modules.

4. A modular innerspring assembly as set forth in claim 3, wherein said plurality of innerspring modules includes a fifth one of said innerspring modules, said fifth one of said innerspring modules having a first laterally extending side adjacent said second laterally extending side of said third one of said innerspring modules.

5. A modular innerspring assembly as set forth in claim 4, wherein said plurality of innerspring modules includes a sixth one of said innerspring modules, said sixth one of said innerspring modules having a first laterally extending side adjacent said second laterally extending side of said fourth one of said innerspring modules and having its said second longitudinally extending side adjacent said first longitudinally extending side of said fifth one of said innerspring modules.

6. A modular innerspring assembly as set forth in claim 5, wherein said first, second, third, fourth, fifth and sixth ones of said innerspring modules each have a lateral dimension substantially equal to eighteen inches and a longitudinal dimension substantially equal to twenty four inches, whereby said modular innerspring assembly has a lateral and longitudinal dimension corresponding to that of a twin size mattress in which said innerspring assembly may be used.

7. A modular innerspring assembly as set forth in claim 5, wherein said first, second, third, fourth, fifth and sixth ones of said innerspring modules each have a lateral dimension substantially equal to eighteen inches and a longitudinal dimension substantially equal to twenty six inches, whereby said modular innerspring assembly has a lateral and longitudinal dimension corresponding to that of a twin size extra long mattress in which said innerspring assembly may be used.

8. A modular innerspring assembly as set forth in claim 5, wherein said first, second, third, fourth, fifth and sixth ones of said innerspring modules each have a lateral dimension substantially equal to twenty six inches and a longitudinal dimension substantially equal to twenty four inches, whereby said modular innerspring assembly has a lateral and longitudinal dimension corresponding to that of a full size mattress in which said innerspring assembly may be used.

9. A modular innerspring assembly as set forth in claim 5, wherein said first, second, third, fourth, fifth and sixth ones of said innerspring modules each have a lateral dimension substantially equal to twenty six inches and a longitudinal dimension substantially equal to twenty six inches, whereby said modular innerspring assembly has a lateral and longitudinal dimension corresponding to that of a full size extra long mattress in which said innerspring assembly may be used.

10. A modular innerspring assembly as set forth in claim 5, wherein said first, second, third, fourth, fifth and sixth ones of said innerspring modules each have a lateral dimension substantially equal to twenty nine inches and a longitudinal dimension substantially equal to twenty six inches, whereby said modular innerspring assembly has a lateral and longitudinal dimension corresponding to that of a queen size mattress in which said innerspring assembly may be used.

11. A modular innerspring assembly as set forth in claim 5, wherein said plurality of innerspring modules includes a seventh one of said innerspring modules, said seventh one of said innerspring modules having its said second longitudinally extending side adjacent said first longitudinally extending side of said second one of said innerspring modules, an eighth one of said innerspring modules, said eighth one of said innerspring modules having its said second longitudinally extending side adjacent said first longitudinally extending side of said fourth one of said innerspring modules and with its said first laterally extending side adjacent said second laterally extending side of said seventh one of said innerspring modules, and a ninth one of said innerspring modules, said ninth one of said innerspring modules having its said second longitudinally extending side adjacent said first longitudinally extending side of said sixth one of said innerspring modules and with its said first laterally extending side adjacent said second laterally extending side of eighth one of said innerspring modules.

12. A modular innerspring assembly as set forth in claim 11, wherein said first, third, fifth, seventh, eighth and ninth ones of said innerspring modules each have a lateral dimension substantially equal to twenty nine inches and a longitudinal dimension substantially equal to twenty six inches, said second, fourth and sixth ones of said innerspring modules each have a lateral dimension substantially equal to sixteen inches and a longitudinal dimension substantially equal to twenty six inches, whereby said modular innerspring assembly has a lateral and longitudinal dimension corresponding to that of a king size mattress in which said innerspring assembly may be used.

13. A modular innerspring assembly as set forth in claim 1, wherein said first connecting means comprises a first elongated length of wire formed in a cylindrical helix to receive said first spring end pieces of adjacent ones of said springs, and said second connecting means comprises a second elongated length of wire formed in a cylindrical helix to receive said second spring end pieces of adjacent one of said springs.

14. A modular innerspring assembly as set forth in claim 1, wherein said first boundary wire assembly comprises a first L-shaped length of wire having a laterally extending leg and a longitudinally extending leg, a first elongated sleeve member to receive the end of said laterally extending leg of said first L-shaped length of wire in a first end thereof, said first elongated sleeve member having said first end thereof and an oppositely located second end, a second L-shaped length of wire having a laterally extending leg and a longitudinally extending leg, a second elongated sleeve member to receive the end of said longitudinally extending leg of said second L-shaped length of wire in a first end thereof, said second elongated sleeve member having said first end thereof and an oppositely located second end, the end of said laterally extending leg of said second L-shaped length of wire being received in the said second end of said first elongated sleeve member, a first straight length of wire having a first and second end, said first end of said first straight length of wire received in the said second end of said second elongated sleeve member, a third elongated sleeve member to receive the said second end of said first straight length of wire in one end thereof, said third elongated sleeve member having said first end thereof and an oppositely located second end a third L-shaped length of wire having a laterally extending leg and a longitudinally extending leg, the end of said longitudinally extending leg of said third L-shaped length of wire being received in the said second end of said third elongated sleeve member, a fourth elongated sleeve member having a first end and an oppositely located second end, the end of said laterally extending leg of said third L-shaped length of wire being received in said first end of said fourth elongated sleeve member, a fourth L-shaped length of wire having a laterally extending leg and a longitudinally extending leg, the end of said laterally extending leg of said fourth L-shaped length of wire being received in the said second end of said fourth elongated sleeve member, a fifth elongated sleeve member having a first end and an oppositely located second end, the end of said longitudinally extending leg of said fourth L-shaped length of wire being received in said first end of said fifth elongated sleeve member, a second straight length of wire having a first and second end, said first end of said second straight length of wire being received in the said second end of said fifth elongated sleeve member, a sixth elongated sleeve member having a first end and an oppositely located second end, the said second end of said second straight length of wire being received in said first end of said sixth elongated sleeve member, the end of said longitudinally extending leg of said first L-shaped length of wire being received in the said second end of said sixth elongated sleeve member.

15. A modular innerspring assembly for a mattress as set forth in claim 1, wherein said third connecting means comprises a first clip member having a first arcuate hook at one end and a second arcuate hook at its opposite end, said first arcuate hook having a first arcuate receiving pocket having a cross-sectional configuration and dimension corresponding to that of a one of said first spring end pieces for snug reception in said first arcuate receiving pocket, said first arcuate hook of said first clip member having a first entrance space opening to said first arcuate receiving pocket which is smaller than the cross-sectional dimension of said pocket, said first arcuate hook being sufficiently resilient for said first entrance space to expand enough under pressure for a one of said first spring end pieces to pass into said first arcuate receiving pocket after which it contracts to its original dimension, said second arcuate hook of said first clip member having a second arcuate receiving pocket having a cross-sectional configuration and dimension corresponding to that of a portion of said first boundary wire assembly for snug reception in said second arcuate receiving pocket, said second arcuate hook of said first clip member having a second entrance space opening to said second arcuate receiving pocket which is smaller than the cross-sectional dimension of said pocket, said second arcuate hook being sufficiently resilient for said second entrance space to expand enough under pressure for a said portion of said first boundary wire assembly to pass into said second arcuate receiving pocket after which it contracts to its original dimension.

16. A modular innerspring assembly for a mattress as set forth in claim 15, wherein said fourth connecting means comprises a second clip member having a first arcuate hook at one end and a second arcuate hook at its opposite end, said first arcuate hook having a first arcuate receiving pocket having a cross-sectional configuration and dimension corresponding to that of a one of said second spring end pieces for snug reception in said first arcuate receiving pocket, said first arcuate hook of said second clip member having a first entrance space opening to said first arcuate receiving pocket which is smaller than the cross-sectional dimension of said pocket, said first arcuate hook being sufficiently resilient for said first entrance space to expand enough under pressure for a one of said second spring end pieces to pass into said first arcuate receiving pocket after which it contracts to its original dimension, said second arcuate hook of said second clip member having a second arcuate receiving pocket having a cross-sectional configuration and dimension corresponding to that of a portion of a said second boundary wire assembly for snug reception in said second arcuate receiving pocket, said second arcuate hook of said second clip member having a second entrance space opening to said second arcuate receiving pocket which is smaller than the cross-sectional dimension of said pocket, said second arcuate hook being sufficiently resilient for said second entrance space to expand enough under pressure for a said portion of said second boundary wire assembly to pass into said second arcuate receiving pocket after which it contracts to its original dimension.

17. A modular box spring assembly comprising a plurality of box spring modules wherein each one of said plurality of box spring modules is initially made as a separate and independent structure, each one of said box spring modules in said plurality thereof comprising a frame member having an upwardly facing surface lying in a first plane, a plurality of springs extending upwardly from said upwardly facing surface of said frame member and terminating in a plane which is substantially parallel to said first plane, said frame member having a first laterally extending end wall, a first longitudinally extending side wall extending from one end of said first laterally extending end wall normal thereto and terminating at an opposite end, a second laterally extending end wall extending from said opposite end of said first longitudinally extending side wall normal thereto in the same direction as said first laterally extending end wall and terminating at an opposite end, a second longitudinally extending side wall extending from said opposite end of said second laterally extending end wall normal thereto to the other end of said first laterally extending end wall, a first one of said box spring modules being placed with said first longitudinally extending side wall adjacent to a second longitudinally extending side wall of a second one of said box spring modules, including said second one of said box spring modules having said second longitudinally extending side walls, and adjacent wall connecting means to connect and hold adjacent walls of said box spring modules together, said adjacent wall connecting means including a first upwardly extending member secured to a side wall of a said first one of said box spring modules, a second upwardly extending member secured to a side wall of a second one of said box spring modules adjacent to and in facing relationship with said first upwardly extending member, and releasable securing means to releasably secure said first and second upwardly extending members together.

18. A modular box spring assembly as set forth in claim 17, wherein said plurality of box spring modules includes a third one of said box spring modules, said third one of said box spring modules having a first laterally extending end wall adjacent said second laterally extending end wall of said first one of said box spring modules.

19. A modular box spring assembly as set forth in claim 18, wherein said plurality of box spring modules includes a fourth one of said box spring modules, said fourth one of said box spring modules having a first laterally extending end wall adjacent said second laterally extending end wall of said second one of said box spring modules and having its said second longitudinally extending side wall adjacent said first longitudinally extending side wall of said third one of said box spring modules.

20. A modular box spring assembly as set forth in claim 19, wherein said first, second, third and fourth ones of said box spring modules each have a lateral dimension substantially equal to eighteen inches and a longitudinal dimension substantially equal to thirty seven inches, whereby said modular box spring assembly has a lateral and longitudinal dimension corresponding substantially to that of a twin size mattress for use therewith.

21. A modular box spring assembly as set forth in claim 19, wherein said first, second, third and fourth ones of said box spring modules each have a lateral dimension substantially equal to twenty six inches and a longitudinal dimension substantially equal to thirty seven inches, whereby said modular box spring assembly has a lateral and longitudinal dimension corresponding substantially to that of a full size mattress for use therewith.

22. A modular box spring assembly as set forth in claim 19, wherein said first, second, third and fourth ones of said box spring modules each have a lateral dimension substantially equal to twenty six inches and a longitudinal dimension substantially equal to thirty nine inches, whereby said modular box spring assembly has a lateral and longitudinal dimension corresponding substantially to that of a full size extra long mattress for use therewith.

23. A modular box spring assembly as set forth in claim 19, wherein said first, second, third and fourth ones of said box spring modules each have a lateral dimension substantially equal to twenty nine inches and a longitudinal dimension substantially equal to thirty nine inches, whereby said modular box spring assembly has a lateral and longitudinal dimension corresponding substantially to that of a queen size mattress for use therewith.

24. A modular box spring assembly as set forth in claim 19, wherein said first, second, third and fourth ones of said box spring modules each have a lateral dimension substantially equal to eighteen inches and a longitudinal dimension substantially equal to thirty nine inches, thereby comprising a first modular box spring assembly having a lateral and longitudinal dimension corresponding substantially to that of a twin size extra long mattress for use therewith.

25. A modular box spring assembly as set forth in claim 24, including a second modular box spring assembly having a lateral and longitudinal dimension corresponding substantially to that of a twin size extra long mattress, said second such modular box spring assembly being adjacent said first modular box spring assembly having a lateral and longitudinal dimension corresponding substantially to that of a twin size extra long mattress along respective longitudinal sides of each to thereby comprise a modular box spring assembly having a lateral and longitudinal dimension corresponding substantially to that of a king size mattress for use therewith.

26. A modular box spring assembly as set forth in claim 17, wherein said frame member comprises a first end strip along said first laterally extending end wall, a first side strip along said first longitudinally extending side wall, a second end strip along said second laterally extending end wall, a second side strip along said second longitudinally extending side wall, and a plurality of spaced apart intermediate strips located between said end and side strips.

27. A modular box spring assembly comprising a plurality of box spring modules wherein each one of said plurality of box spring modules is initially made as a separate and independent structure, each one of said box spring modules in said plurality thereof comprising a frame member having an upwardly facing surface lying in a first plane, a plurality of springs extending upwardly from said upwardly facing surface of said frame member and terminating in a plane which is substantially parallel to said first plane, said frame member having a first laterally extending end wall, a first longitudinally extending side wall extending from one end of said first laterally extending end wall normal thereto and terminating at an opposite end, a second laterally extending end wall extending from said opposite end of said first longitudinally extending side wall normal thereto in the same direction as said first laterally extending end wall and terminating at an opposite end, a second longitudinally extending side wall extending from said opposite end of said second laterally extending end wall normal thereto to the other end of said first laterally extending end wall, a first one of said box spring modules being placed with said first longitudinally extending side wall adjacent to a second longitudinally extending side wall of a second one of said box spring modules, including said second one of said box spring modules having said second longitudinally extending side walls, and adjacent wall connecting means to connect and hold adjacent walls of said box spring modules together, wherein said adjacent wall connecting means comprises a first elongated L-shaped member having a vertically extending leg and a horizontally extending leg and a second elongated L-shaped member having a vertically extending leg and a horizontally extending leg, said horizontally extending leg of said first L-shaped member being secured to said first longitudinally extending side wall of said first one of said box spring modules, said horizontally extending leg of said second L-shaped member being secured to said second longitudinally extending side wall of said second one of said box spring modules at a location facing said first L-shaped member, said vertically extending legs of said first and second L-shaped members being in abutting relationship with each other, and releasable securing means to releasably secure said L-shaped members together.

* * * * *